US009951302B2

(12) United States Patent
Hunt, Jr. et al.

(10) Patent No.: US 9,951,302 B2
(45) Date of Patent: Apr. 24, 2018

(54) LABEL REMOVAL SOLUTION FOR LOW TEMPERATURE AND LOW ALKALINE CONDITIONS

(71) Applicant: Ecolab USA Inc., St. Paul, MN (US)

(72) Inventors: Clinton Hunt, Jr., Lakeville, MN (US); Kim R. Solomon, River Falls, WI (US); Ralf Krack, Dusseldorf (DE)

(73) Assignee: ECOLAB USA INC., Saint Paul, MN (US)

( * ) Notice: Subject to any disclaimer, the term of this patent is extended or adjusted under 35 U.S.C. 154(b) by 0 days.

(21) Appl. No.: 15/291,768

(22) Filed: Oct. 12, 2016

(65) Prior Publication Data

US 2017/0029746 A1 Feb. 2, 2017

Related U.S. Application Data

(60) Division of application No. 14/459,732, filed on Aug. 14, 2014, now Pat. No. 9,487,735, which is a (Continued)

(51) Int. Cl.
*C11D 7/50* (2006.01)
*C11D 3/43* (2006.01)
(Continued)

(52) U.S. Cl.
CPC ..... *C11D 3/43* (2013.01); *C11D 1/521* (2013.01); *C11D 3/044* (2013.01); *C11D 3/32* (2013.01); *C11D 11/0035* (2013.01)

(58) Field of Classification Search
CPC ..... C11D 3/43
(Continued)

(56) References Cited

U.S. PATENT DOCUMENTS 3,956,791 A 5/1976 Rutten
4,370,174 A 1/1983 Braithwaite
(Continued)

FOREIGN PATENT DOCUMENTS

DE 3642564 A1 12/1986
EP 0237127 A1 9/1987
(Continued)

OTHER PUBLICATIONS

ECOLAB USA INC. et al., PCT/US2013/029921 filed Mar. 8, 2013, "Notification of Transmittal of the International Search Report and the Written Opinion of the International Searching Authority, or the Declaration" dated Jun. 24, 2013.
(Continued)

*Primary Examiner* — Gregory E Webb
(74) *Attorney, Agent, or Firm* — McKee, Voorhees & Sease, PLC

(57) ABSTRACT

According to the invention, the compositions and methods provide for the complete removal of synthetic glues or adhesives from a plurality of surfaces through the use of amide solvents in combination with surfactants, chelants, acidulants and/or additional bottle wash additives. Beneficially, the compositions and methods are suitable for use at lower temperatures, including below 35° C., and lower pH conditions, including from 5 to 10, from 6 to 9, and from 6 to 8, in comparison to conventional caustic-based adhesive removal compositions.

11 Claims, 12 Drawing Sheets

Related U.S. Application Data continuation-in-part of application No. 13/789,763, filed on Mar. 8, 2013, now Pat. No. 9,133,426.

(60) Provisional application No. 61/646,440, filed on May 14, 2012.

(51) Int. Cl.

| | |
|---|---|
| ***C11D 11/00*** | (2006.01) |
| ***C11D 1/52*** | (2006.01) |
| ***C11D 3/32*** | (2006.01) |
| ***C11D 3/04*** | (2006.01) |

(58) Field of Classification Search
USPC ..... 510/200
See application file for complete search history.

(56) References Cited

U.S. PATENT DOCUMENTS

| | | | | |
|---|---|---|---|---|
| 4,803,012 | A | 2/1989 | Wershofen | |
| 5,096,767 | A | 3/1992 | Harada et al. | |
| 5,849,095 | A | 12/1998 | Rouillard | |
| 6,017,863 | A * | 1/2000 | Cala | C11D 3/26 510/175 |
| 6,057,276 | A * | 5/2000 | Smith | C11D 3/046 134/38 |
| 6,103,686 | A | 8/2000 | Asakawa et al. | |
| 6,399,554 | B1 | 6/2002 | Harrington et al. | |
| 6,448,210 | B1 | 9/2002 | Keyes et al. | |
| 6,518,230 | B2 * | 2/2003 | Wu | C09D 9/04 510/200 |
| 6,530,386 | B1 | 3/2003 | Bragulla et al. | |
| 6,537,492 | B1 | 3/2003 | Sogaard | |
| 6,554,005 | B1 | 4/2003 | Cords et al. | |
| 6,590,019 | B2 | 7/2003 | Dheret et al. | |
| 6,803,085 | B2 | 10/2004 | Blom et al. | |
| 6,835,702 | B2 | 12/2004 | Herdt et al. | |
| 7,148,188 | B2 * | 12/2006 | Lawrence | C11D 1/06 510/174 |
| 7,341,982 | B2 | 3/2008 | Lentsch et al. | |
| 7,541,048 | B2 | 6/2009 | DeWitt et al. | |
| 7,674,365 | B2 | 3/2010 | Banavali et al. | |
| 7,951,245 | B2 | 5/2011 | Levitt et al. | |
| 7,964,544 | B2 | 6/2011 | Smith et al. | |
| 7,977,294 | B2 | 7/2011 | Dufresne et al. | |
| 8,097,760 | B2 | 1/2012 | Zhao et al. | |
| 8,211,847 | B1 | 7/2012 | Ensinger et al. | |
| 8,252,939 | B2 | 8/2012 | Paulini et al. | |
| 2001/0009951 | A1 | 7/2001 | Schmidt et al. | |
| 2002/0151628 | A1 | 10/2002 | Dheret et al. | |
| 2003/0015219 | A1 | 1/2003 | Kravitz et al. | |
| 2004/0147422 | A1 * | 7/2004 | Hatch | C23G 1/125 510/202 |
| 2005/0192207 | A1 | 9/2005 | Morgan, III et al. | |
| 2006/0111267 | A1 | 5/2006 | Clifton et al. | |
| 2006/0167276 | A1 | 7/2006 | Huang et al. | |
| 2007/0099807 | A1 | 5/2007 | Smith et al. | |
| 2007/0202067 | A1 | 8/2007 | Kolly-Hemandez et al. | |
| 2007/0259140 | A1 | 11/2007 | Marlow | |
| 2008/0023031 | A1 | 1/2008 | Kellar et al. | |
| 2008/0069986 | A1 | 3/2008 | Clifton et al. | |
| 2008/0146479 | A1 | 6/2008 | Dufresne et al. | |
| 2008/0146480 | A1 * | 6/2008 | Dufresne | C11D 3/124 510/200 |
| 2008/0314409 | A1 | 12/2008 | Theyssen et al. | |
| 2009/0188533 | A1 | 7/2009 | Levitt et al. | |
| 2010/0263324 | A1 | 10/2010 | Jendrichowski et al. | |
| 2011/0067730 | A1 | 3/2011 | Folz et al. | |
| 2011/0190187 | A1 * | 8/2011 | Hawes, III | C09D 9/00 510/174 |
| 2012/0040880 | A1 * | 2/2012 | Rieth | A61K 8/39 510/138 |
| 2012/0149625 | A1 | 6/2012 | Simonsen et al. | |
| 2012/0172451 | A1 | 7/2012 | Matharu | |
| 2012/0207805 | A1 | 8/2012 | Colman et al. | |
| 2013/0225469 | A1 | 8/2013 | Allen et al. | |

FOREIGN PATENT DOCUMENTS

| | | | |
|---|---|---|---|
| EP | 1347038 | A1 | 9/2003 |
| EP | 1967458 | A1 | 9/2008 |
| FR | 2843971 | | 8/2002 |
| GB | 1093935 | | 12/1967 |
| GB | 2411877 | A | 9/2005 |
| GB | 2411878 | A | 9/2005 |
| GB | 2411879 | A | 9/2005 |
| GB | 2411880 | A | 9/2005 |
| GB | 2411881 | A | 9/2005 |
| GB | 2411882 | A | 9/2005 |
| GB | 2414979 | A | 12/2005 |
| JP | 06033096 | A | 2/1994 |
| JP | 2008138072 | A | 6/2008 |
| JP | 2009149743 | A | 7/2009 |
| WO | 9719157 | A1 | 5/1997 |
| WO | 9729016 | A1 | 8/1997 |
| WO | 9735292 | A1 | 9/1997 |
| WO | 9824844 | A1 | 6/1998 |
| WO | 9828392 | A1 | 7/1998 |
| WO | 0185866 | A2 | 11/2001 |
| WO | 0208371 | A2 | 1/2002 |
| WO | 2004027001 | A1 | 4/2004 |
| WO | 2005026410 | A2 | 3/2005 |
| WO | 2005085381 | A1 | 9/2005 |
| WO | 2006052578 | A2 | 5/2006 |
| WO | 2006072385 | A1 | 7/2006 |
| WO | 2007051473 | A1 | 5/2007 |
| WO | 2007131245 | A2 | 11/2007 |
| WO | 2009108552 | A1 | 9/2009 |
| WO | 2010027507 | A2 | 3/2010 |
| WO | 2010117767 | A1 | 10/2010 |
| WO | 2011150224 | A1 | 12/2011 |

OTHER PUBLICATIONS

European Patent Office, "Extended European Search Report" issued in connection to European Application No. 13790848.9, 10 pages dated Oct. 21, 2015.

Farag, Ahmed A. et al., "The adsorption and corrosion inhibition of some nonionic surfactants on API X65 steel surface in hydrochloric acid", Corrosion Science 64, pp. 174-183, 2012.

Sasai, Ryo et al., "Developmental of an Eco-Friendly Material Recycling Process for Spent Lead Glass Using a Mechanochemical Process and Na2EDTA Reagent" Environ. Sci. Technol. 42, pp. 4159-4164, May 3, 2008.

* cited by examiner

LABEL REMOVAL SOLUTION FOR LOW TEMPERATURE AND LOW ALKALINE CONDITIONS

CROSS-REFERENCE TO RELATED APPLICATIONS

This application is a divisional application of Ser. No. 14/459,732 filed Aug. 14, 2014, which is a continuation-in-part application of U.S. application Ser. No. 13/789,763 filed Mar. 8, 2013, now U.S. Pat. No. 9,133,426 issued Sep. 15, 2015, which is a nonprovisional application of U.S. Provisional Application No. 61/646,440, filed May 14, 2012, each of which are herein incorporated by reference in its entirety.

FIELD OF THE INVENTION

The invention relates to compositions and methods useful in the removal of adhesive labels and/or residues from surfaces, such as returnable bottles and similar containers used in the beverage and food industry. In particular, the compositions and methods remove paper and/or aluminum labels from such surfaces employing cost-effective compositions. The methods and compositions use lower caustic compositions to enable lower temperature conditions for the bottle label removal. Beneficially, methods of invention remove labels without destruction of the same through the use of adhesive release agents which maintain the union of the adhesive residues and the label itself reducing the overall cost and processing of label removal processes, such as for example by reducing or eliminating the need for deflocculation steps.

BACKGROUND OF THE INVENTION

It is common practice in the bottling industry to reuse, recycle, re-wash and refill returned bottles after consumer use of the item in an effort towards economy in the industry. Synthetic glues or adhesives are commonly used to affix labels and other items to surfaces, including bottles. Exemplary disclosures of synthetic glues and adhesives are provided in U.S. Pat. No. 6,803,085, which is incorporated herein by reference in its entirety. It is desirable to fully remove soils to clean the bottles as well as remove the labeling and any remaining adhesive residue left on the surface prior to cleaning, disinfecting and reuse. Unfortunately, synthetic glues can be difficult to remove from surfaces such as glass bottles and any incomplete removal presents difficulty in reusing the item. In addition, conventional removal methods may only partially remove labels and/or destroy the labels creating additional buildup in the cleaning solutions (e.g. partially degraded labels).

It is known that bottle wash additives and alkaline detergent compositions along with bottle washing operations may be used to clean returned bottles. Numerous conventional aqueous-based bottle washing compositions contains caustics, alcohols, nonionic surfactants and/or other additives. Exemplary disclosures of bottle washing operations include U.S. Pat. No. 2,976,248 titled "Bottle Washing Composition and Method," filed Aug. 1, 1957, and U.S. Pat. No. 6,530,386 titled "Method of Cleaning Returnable Bottles," filed Jan. 25, 2000. However, such additives and detergents often incompletely remove adhesives and leave residues or deposits on the surfaces, providing commercially undesirable results. In addition, commercially-available bottle wash additives often require repeated use to fully remove residues, utilize harsh cleaning conditions and/or require of large amounts of cleaning solutions or concentrates, all of which increase the time and cost of bottle washing.

It is therefore desirable to provide cleaning solutions and methods of use according to the invention that provide for the complete removal of glues and adhesives. This is a difficult task to design cleansing compositions and methods for the removal of adhesive and other substances.

Accordingly, it is an objective of the claimed invention to develop methods for complete removal of various types of adhesives and other residues from surfaces, such as adhesive residue on returnable glass bottles.

A further object of the invention is novel cleaning compositions for removal of paper and/or aluminum labels from glass bottles.

A still further object of the invention is to develop methods for removal of adhesive labels and residue at reduced temperature and/or caustic levels without increase in time required for such removal.

A still further object of the invention is to develop methods for removal of adhesive labels without destroying the labels and/or causing pulping. These and other objects of the invention are illustrated in the description of the invention

BRIEF SUMMARY OF THE INVENTION

Methods and compositions for complete removal of adhesive material from a bottle, such as glass bottles, by penetration of the label's surface to remove the adhesive from the bottle are provided. The methods and compositions remove labels and adhesive residue using a preferred solvent system allowing lower temperature and/or caustic conditions without increasing the time required for such removal. An advantage of the invention is the complete removal of adhesive residues on bottles, providing convenient and cost-effective removal. The invention provides advantages over commercially-available cleaning compositions and methods by both completely removing bottle labels along with the underlying adhesive residue.

In an aspect, a method for removing adhesive material from a surface includes: applying a cleaning composition to a surface in need of removal of an adhesive material affixed to a label; and removing said adhesive material from the surface within a period of time less than about 10 minutes. In preferred aspects, the cleaning composition comprises an aqueous or non-aqueous amide solvent and optionally an additional organic solvent, and less than about 25 wt-% sodium hydroxide (caustic), wherein the solvents replaces at least a portion of a caustic solution. Still further the methods for removing adhesive material from a surface are preferably below about 50° C., preferably below about 35° C.

In a further aspect, a method for removing adhesive material from a glass surface includes: applying a cleaning composition to a glass surface in need of adhesive removal; and removing said adhesive from the glass surface within a period of time less than about 10 minutes. In an aspect, the adhesive has one or more layers of adhesive, laminate and/or other synthetic or natural (e.g. casein) adhesive residue, and one of more of said layers is a polyacrylic acid or aminocarboxylate. In a further aspect, the cleaning composition comprises an aqueous or non-aqueous saturated amide solvent, a surfactant, optionally a chelant and less than about 25 wt-% sodium hydroxide (caustic), wherein the organic solvent and/or amine solvent replaces at least a portion of a caustic solution from the cleaning composition. In a still further aspect, the cleaning composition has a pH between about 5 to 10, and the cleaning composition is applied at a temperature less than about 35° C.

In a still further aspect, a composition for removing adhesive material from a surface includes: an aqueous or non-aqueous amine solvent and optionally an additional organic solvent (e.g. amines, esters, alcohols); a surfactant, and optionally a chelant, and less than about 25 wt-% sodium hydroxide. In a preferred aspect, the composition effectively removes an adhesive material from a surface at a composition pH between about 5 to 10 within a period of time less than about 10 minutes at temperatures less than about 35° C.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
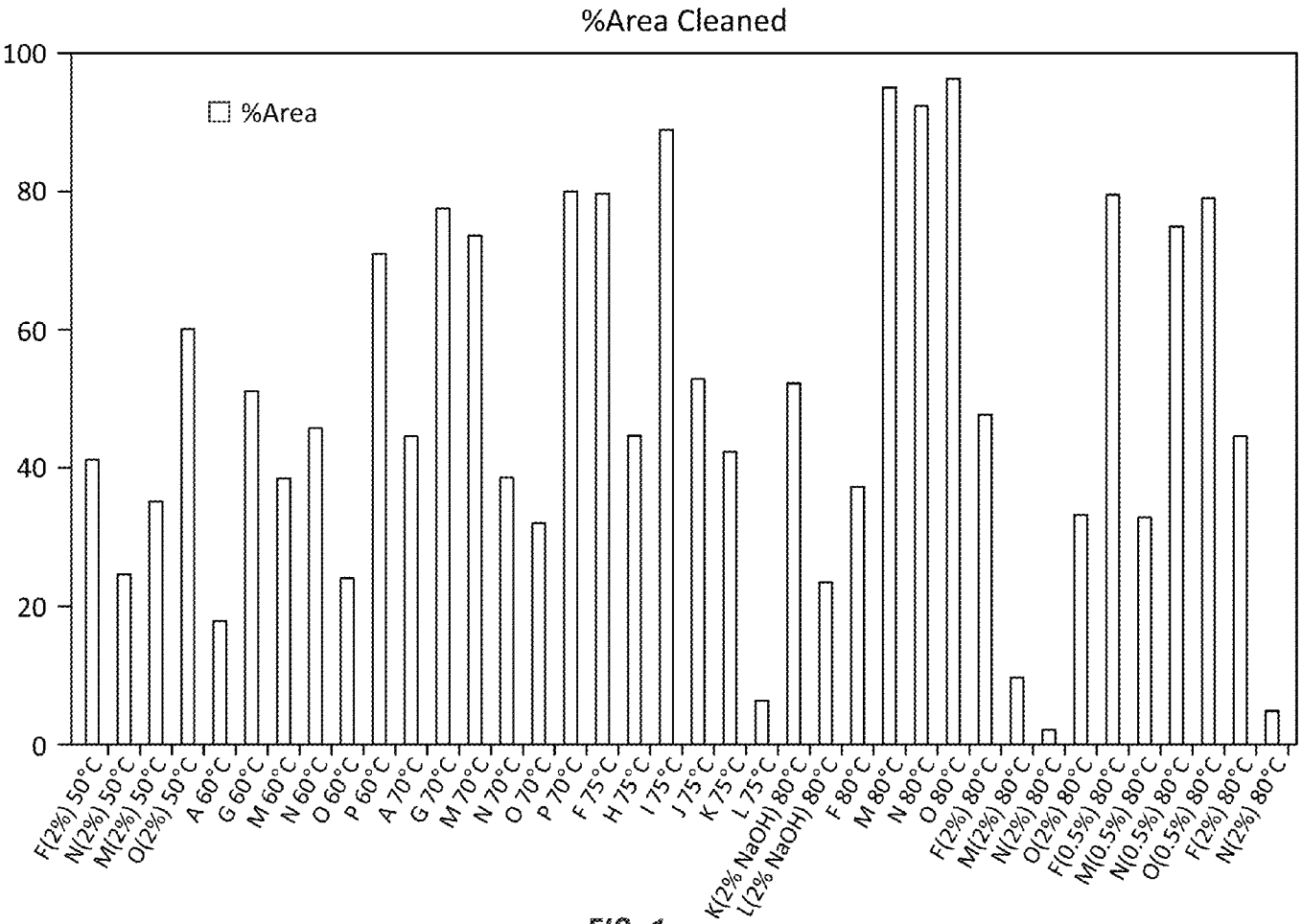
FIG. 1 shows graphical results of adhesive removal efficacy according to embodiments of the invention set forth in Example 3.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

The present invention relates to methods and compositions for complete removal of adhesive material from a bottle, such as glass bottles. The compositions and methods of the present invention have many advantages over conventional bottle washing compositions used to remove adhesive labels. For example, the methods achieve substantially complete and/or complete removal of adhesive labels while using lower temperature, less time and/or lower caustic conditions. In a preferred aspect, the methods achieve complete removal of the adhesive label and all adhesive residues while using lower temperature and caustic conditions without any increase in time for such removal. An advantage of the invention is the complete removal of adhesive residues on bottles, providing convenient and cost-effective removal. The invention provides advantages over commercially-available cleaning compositions and methods by both completely removing bottle labels along with the underlying adhesive residue.

The embodiments of this invention are not limited to particular compositions or methods for removal of synthetic glue residues from bottle surfaces, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

The terms "adhesive," "adhesive residue," "glue," and variations thereof, as used herein, refer to any synthetic adhesive or glue used to adhere a substance to a surface, namely glass surfaces such as glass bottles with paper labels adhered to its surface. According to the invention, examples of adhesives include polyacrylic acid adhesives, or any polymer of a polycarboxylate.

The term "alkyl" refers to a straight or branched chain monovalent hydrocarbon radical having a specified number of carbon atoms. Alkyl groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halogen, for example. Examples of "alkyl" include, but are not limited to, methyl, ethyl, n-propyl, isopropyl, n-butyl, s-butyl, t-butyl, n-pentyl, n-hexyl, 3-methylpentyl, and the like.

The term "alkoxy" refers to a straight or branched chain monovalent hydrocarbon radical having a specified number of carbon atoms and a carbon-oxygen-carbon bond, may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halogen, for example. Examples include methoxy, ethoxy, propoxy, t-butoxy, and the like.

As used herein, the phrase "applied color design" refers to a design, decoration, decorative element, or label that is applied in a fashion which is intended to be permanent while the article, for example a bottle, is in circulation, use, and/or reuse. One type of applied color design is referred to herein as an "applied ceramic label" (ACL). An applied ceramic label is a label that is applied in a fashion which is intended to be permanent while the article, e.g. bottle, is in circulation, use and/or reuse.

As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%. In a preferred embodiment of the invention the cleaning compositions are substantially free of caustic and other caustic containing components (e.g. alkalinity sources), preferably the cleaning compositions are free of caustic and other caustic containing components.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions of the present invention may comprise, consist essentially of, or consist of the components and ingredients (or method steps) of the present invention as well as other components and ingredients (or method steps) described herein. As used herein, "consisting essentially of" means that the methods and compositions may include additional steps, components or ingredients, but only if the additional steps, components or ingredients do not materially alter the basic and novel characteristics of the claimed methods and compositions.

While an understanding of the mechanism is not necessary to practice the present invention and while the present invention is not limited to any particular mechanism of action, it is contemplated that, in some embodiments the compositions of the invention and methods of using the same provide significant advantage over commercially-available bottle wash additives and cleaning methods. According to the invention, both bottle labels (e.g. paper and aluminum) and underlying adhesive residue are completely removed without compromising overall bottle cleaning performance and/or creating any pulping or other residue in the label removal system. Cleaning performance according to the invention exceeds that of existing commercially-available bottle wash additives that fail to completely remove adhesive residue from bottles and/or require higher caustic and/or temperature conditions for the removal of such adhesive labels. As a result, the compositions and methods according to the invention represent a significant advantage in cost savings and efficiency for industries including recycling and reuse of bottles, namely glass bottles.

According to the invention, the compositions and methods provide for the complete removal of synthetic glues and/or adhesives through the use of amide solvents. The cleaning compositions according to the invention allow the use of lower temperatures, lower caustic concentrations and reduced time required for the removal of the synthetic glues and/or adhesives which remain affixed to the labels removed. Although not intending to be limited to a particular theory, the compositions and methods according to the invention provide chemistry that is capable of solubilizing and/or penetrating the labels and glues and/or adhesives affixed thereto in order to remove the adhesives in combination with the labels affixed thereto. The steps of penetrating and/or solubilizing the synthetic glues and/or adhesives beneficially allow the complete removal of labels intact.

Cleaning Compositions

The cleaning compositions according to the invention are particularly suitable for various bottle washing applications, including label removal. Beneficially, the cleaning compositions provide efficient and effective label removal, while reducing the overall cost of the chemical compositions, reducing the temperature conditions, reducing the caustic conditions and/or reducing the mechanical effects required for the label removal and cleaning of the article. The cleaning compositions according to the invention may comprise, consist of and/or consist essentially of an amide solvent. The compositions may also include a chelant, acidulant, additional solvents, surfactants and/or other functional ingredients as set forth herein the description of the invention.

Various embodiments of the cleaning compositions are shown in Table 1.

TABLE 1

| Component | Wt-% Ranges | | |
|---|---|---|---|
| Amide Solvent (adhesive release agent) | 0.1-30 | 0.1-10 | 1-5 |
| Chelant (e.g. Bayhibit, Dequest) | 0-20 | 0.01-10 | 0.1-10 |
| Acidulant (e.g. citric acid, gluconic acid or gluconate) | 0-50 | 0.1-50 | 5-30 |
| Other Solvent/Adhesive Release Agent(s) (e.g. amines, esters) | 0-30 | 0-10 | 1-5 |
| Surfactant | 0-50 | 5-40 | 10-30 |
| Water Diluent | 10-90 | 10-70 | 20-60 |
| Other Components | 0-20 | 0.1-20 | 1-20 |

In an aspect of the invention, an acid and base formula is provided that when combined with a caustic solution forms the salt of the formula to provide a chelating agent. In a further aspect of the invention, an amide solvent provides a means for effective label removal from a treated surface. In further aspects, an amide solvent is provided in synergy (i.e. at a lower concentration) with an amine solvent. In yet further aspects, an amide solvent is provided in combination with one or more of an amine solvent and/or ester (e.g. dibasic acid ester) for effective label removal from a treated surface. In some embodiments, the cleaning composition does not include a surfactant and/or other cleaning agent (including for example an alkaline and/or acidic cleaning agent).

In some embodiments, the cleaning compositions of the present invention have a pH nearing neutral. In some embodiments, the cleaning compositions have a pH from about 5 to about 10, preferably from about 6 to about 9, and more preferably from about 6 to about 8. In some aspects, the pH approaches a neutral pH to effectively avoid corrosion of treated surfaces and articles.

Adhesive Release Agent Solvents

The compositions according to the invention include an amide solvent as an adhesive release agent. An amide solvent as an adhesive release agent solvent or combination of solvents is useful in the cleaning compositions of the invention to enhance certain adhesive removal properties. Suitable solvents include water in combination with other solvents disclosed herein. In some aspects the water is included as a diluent for the cleaning compositions. The water can include water from any source including deionized water, tap water, softened water, and combinations thereof. In an aspect, deionized water is a preferred source in the formulations according to the invention. Without being limited to a particular mechanism of action, in certain formulations deionized water prevents the hydrolysis of ester components, such as dibasic acid esters (e.g. Rhodiasolv IRIS) which may be included in formulations according to the invention.

In an aspect, amide solvents suitable for use as adhesive release agents include amides. Amides can be described according to the invention for example as solvents having at least one of the following organic amide, sulfonamide and/or phosphoramide functional groups, respectively:

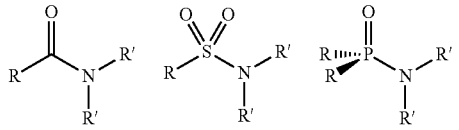

wherein R and/or R' refer to H or organic groups.

Amides can be described according to the invention as having a functional group with the following formula: $R_nE(O)xNR'_2$, wherein R and/or R' refer to H or organic groups, n is at least 1 (n=1, various organic amides and phosphoramides; x=2, sulfonamides), E is C (organic amides), S (sulfonamides), or P (phosphoramides), and x is at least 1 (x=1, organic amides and phosphoramides; x=2, sulfonamides). Suitable amides may further include conjugate bases of ammonia and/or amines, which are often referred to as anionic amides. Still further, suitable amides include derivatives of carboxylic acids (i.e. amine or ammonia replaces the hydroxyl group).

Suitable amides may further include cyclic amides.

In an aspect, R (organic groups of the amide structures) is at least C8 or greater, in an aspect between C8-C10, between C8-C12, between C8-16. Conventionally, amides employed for providing surface activity in various cleaning applications employ longer chain structures, such as C12-C14 or C16-C22. Therefore, it is unexpected that the shorter chain lengths employed according to the invention achieve the beneficial adhesive release. In a preferred aspect, the amide structure is greater than C8, preferably C10 or greater.

The alkyl group of the amide solvents according to the invention may include saturated and/or unsaturated structures. In a preferred aspect, the amide solvent is saturated. Exemplary commercially-available amide solvents include Steposol M-10 and Steposol M-8-10 (Stepan Company), respectively decanamide, N,N-dimethyl and a blend of octanamide, N,N-dimethyl and decanamide, N,N-dimethyl (40-70% octanamide, 30-60% decanamide).

According to the invention the adhesive release agent solvent (optionally including additional solvents) are typically present at from about 0.01 wt-% to about 30 wt-%, or from about 0.1 wt-% to about 20 wt-%, or from about 1 wt-% to about 10 wt-%. In a preferred aspect, the amide solvent adhesive release agent is provided in a concentration of at least about 2 wt-% when employed as the only solvent adhesive release agent in a formulation. In a further preferred aspect, the amide solvent adhesive release agent is provided in a concentration of at least about 0.5 wt-% or 1 wt-% when employed in a synergistic combination with an amine solvent and/or an ester adhesive release agent in a formulation. In some aspects of a synergistic combination of adhesive release agents, the combination of solvents provide at least about 2 wt-% of adhesive release agents. Without limiting the scope of the invention, the ranges recited are inclusive of the numbers defining the range and include each integer within the defined range.

Additional Solvents (Adhesive Release Agents)

In addition to the adhesive release agent, namely an amide solvent, the cleaning compositions of the invention may further include a non-aqueous or aqueous solvent. In further aspects, the non-aqueous or aqueous solvents may be alkaline and/or acid solvents. In a preferred aspect, the solvents are organic molecules. In a further preferred aspect, the solvents are basic solvents which replace sodium hydroxide solvents conventionally employed in various bottle washing compositions for label removal.

Suitable solvents may include organic solvents, such as alcohols or polyols, and oxygenated solvents, such as lower alkanols, lower alkyl ethers, glycols, aryl glycol ethers and lower alkyl glycol ethers. Additional examples of useful solvents include various alcohols, including methanol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether. Substantially water soluble glycol ether solvents include propylene glycol methyl ether, propylene glycol propyl ether, dipropylene glycol methyl ether, tripropylene glycol methyl ether, ethylene glycol butyl ether, diethylene glycol methyl ether, diethylene glycol butyl ether, ethylene glycol dimethyl ether, ethylene glycol propyl ether, diethylene glycol ethyl ether, triethylene glycol methyl ether, triethylene glycol ethyl ether, triethylene glycol butyl ether, and others.

"Substantially water soluble" solvents are defined as being infinitely or 100% soluble by weight in water at 25° C. "Substantially water insoluble" glycol ether solvents include propylene glycol butyl ether, dipropylene glycol butyl ether, dipropylene glycol propyl ether, tripropylene glycol butyl ether, dipropylene glycol dimethyl ether, propylene glycol phenyl ether, ethylene glycol hexyl ether, diethylene glycol hexyl ether, ethylene glycol phenyl ether, diethylene glycol phenyl ether, and others. "Substantially water insoluble" solvents are defined as 53% by weight or less of solvent is soluble in water at 25° C. Preferred solvents are substantially water-soluble solvents.

For reasons of low cost, commercial availability, and solvent strength, benzyl alcohol is a preferred solvent. These preferred solvents help reduce surface tension and help solubilize adhesives (i.e. penetrate the adhesive for removal according to the invention).

As set forth in related U.S. application Ser. No. 13/789,763 filed Mar. 8, 2013, the compositions of the invention can further contain a non-aqueous or aqueous amine solvent. Suitable amines include, for example, primary, secondary, and/or tertiary amines. Primary, secondary and/or tertiary amines, include monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like. Additional amines may include poly sulfonate ammonium salts, as for example, alkylpoly sulfonate ammonium chloride surfactants such as n-alkyl($C_{12}$-$C_{18}$)dimethylbenzyl ammonium chloride, n-tetradecyldimethylbenzylammonium chloride monohydrate, and a naphthylene-substituted poly sulfonate ammonium chloride such as dimethyl-1-naphthylmethylammonium chloride.

Amines may further include diamines carrying at least one nitrogen linked hydrocarbon group, which represents a saturated or unsaturated linear or branched alkyl group having at least 10 carbon atoms and preferably 16-24 carbon atoms, or an aryl, aralkyl, or alkaryl group containing up to 24 carbon atoms, and wherein the optional other nitrogen linked groups are formed by optionally substituted alkyl groups, aryl group or aralkyl groups or polyalkoxy groups.

Amines may also include amine salt such as monoethanolamine, diethanolamine or triethanolamine. Alkanolamines are also included within the scope of amines useful in combination with the other ingredients of the cleaning compositions. Typical examples of alkanolamines include monoethanolamine, monopropanolamine, diethanolamine, dipropanolamine, triethanolamine, tripropanolamine and the like.

Amines may also include amino alcohols. Typical examples of amino alcohols include 2-amino-2-methyl-1-propanol, 2-amino-1-butanol, 2-amino-2-methyl-1,3-propanediol, 2-amino-2-ethyl-1,3-propanediol, hydroxymethyl aminomethane, and the like.

Particularly suitable amines for use in the cleaning compositions include, for example, triethanolamine, furfurylamine, 4-methylbenzylamine, and Tris[2-(2-methoxyethoxy)-ethyl]amine.

According to the invention solvents (including the adhesive release agent solvent) are typically present at from about 0.01 wt-% to about 30 wt-%, or from about 0.1 wt-% to about 20 wt-%, or from about 1 wt-% to about 10 wt-%. Without limiting the scope of the invention, the ranges recited are inclusive of the numbers defining the range and include each integer within the defined range.

In an aspect of the invention, the solvents (including the adhesive release agent solvent and optional additional solvents) replaces at least a portion of sodium hydroxide (e.g. caustic). In an aspect, the solvent replaces at least about 10 wt-% sodium hydroxide, preferably at least about 25 wt-%, at least about 50 wt-%, at least about 75 wt-%, and most preferably at least about 100 wt-% sodium hydroxide from a cleaning composition. Without limiting the scope of the invention, the ranges recited are inclusive of the numbers defining the range and include each integer within the defined range.

Acidulants

In some embodiments, the cleaning compositions of the present invention include an acidulant. As one skilled in the art will ascertain various acidulants may be incorporated to adjust the pH of the cleaning compositions, including both strong and weak acids which are not limited according to the invention. In addition, acids may be substituted with their conjugates (e.g. gluconic acid or gluconate), which may be employed as "acidulants" herein. In an aspect of the invention, a sufficient amount of acidulant is included to provide a composition having a pH from about 2 to about 10, preferably from about 6 to about 9, and more preferably from about 6 to about 8. In some aspects, the pH approaches a neutral pH to effectively avoid corrosion of treated surfaces and articles. However, the compositions according to the invention provide effective adhesion removal at acid pHs as well.

One skilled in the art will further appreciate that acidulants may be combined with weak chelants and/or descalants. In some embodiments this would result in neutralized cleaning compositions.

According to the invention acidulants are typically present in the compositions in amounts from about 0 wt-% to about 50 wt-%, or from about 0.1 wt-% to about 50 wt-%, or from about 5 wt-% to about 30 wt-%. Without limiting the scope of the invention, the ranges recited are inclusive of the numbers defining the range and include each integer within the defined range.

Surfactants

In some embodiments, the cleaning compositions of the present invention include a surfactant. Additional detergency or cleaning efficacy for the cleaning compositions can be obtained from the use of surfactant materials. Various types of surfactants may be formulated into the cleaning compositions to enhance the penetration and solubilization of the adhesives according to the invention, but it is believed that primarily efficacy for the adhesive removal according to the invention is obtained from the inclusion of the solvents in the cleaning compositions.

Surfactants suitable for use with the compositions of the present invention include, but are not limited to, anionic surfactants, nonionic surfactants, amphoteric surfactants and cationic surfactants. In some embodiments, the cleaning compositions of the present invention include about 0.1 wt-% to about 80 wt-% of a surfactant. In other embodiments the compositions of the present invention include about 1 wt-% to about 50 wt-% of a surfactant. Without limiting the scope of the invention, the ranges recited are inclusive of the numbers defining the range and include each integer within the defined range.

Anionic Surfactants

In some embodiments, the cleaning compositions of the present invention include an anionic surfactant. Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkylaryl ethoxy carboxylates of the following formula:

$$R—O—(CH_2CH_2O)_n(CH_2)_m—CO_2X \quad (3)$$

in which R is a $C_8$ to $C_{22}$ alkyl group or

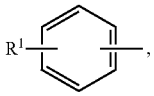

in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

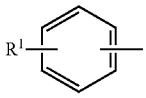

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical). Carboxylates are also available from Clariant, e.g. the product Sandopan® DTC, a $C_{13}$ alkyl polyethoxy (7) carboxylic acid.

Nonionic Surfactants

In some embodiments, the cleaning compositions of the present invention include a nonionic surfactant. Suitable nonionic surfactants suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic and reverse Pluronic surfactants; alcohol alkoxylates, such as Dehypon LS-54 (R-$(EO)_5(PO)_4$) and Dehypon LS-36 (R-$(EO)_3(PO)_6$); and capped alcohol alkoxylates, such as Plurafac LF221 and Tegoten EC11; mixtures thereof, or the like.

The semi-polar type of nonionic surface active agents are another class of nonionic surfactant useful in compositions of the present invention. Semi-polar nonionic surfactants include the amine oxides, phosphine oxides, sulfoxides and their alkoxylated derivatives.

Amine oxides are tertiary amine oxides corresponding to the general formula:

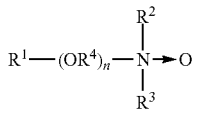

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkylene or a hydroxyalkylene group containing 2 to 3 carbon atoms; and n ranges from 0 to about 20. An amine oxide can be generated from the corresponding amine and an oxidizing agent, such as hydrogen peroxide.

Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, isododecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl) amine oxide, 3,6,9-trioctadecyldimethylamine oxide and 3-dodecoxy-2-hydroxypropyldi-(2-hydroxyethyl)amine oxide.

Amphoteric Surfactants

In some embodiments, the cleaning compositions of the present invention include an amphoteric surfactant. Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" Cosmetics & Toiletries, Vol. 104 (2) 69-71 (1989), which is incorporated herein by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

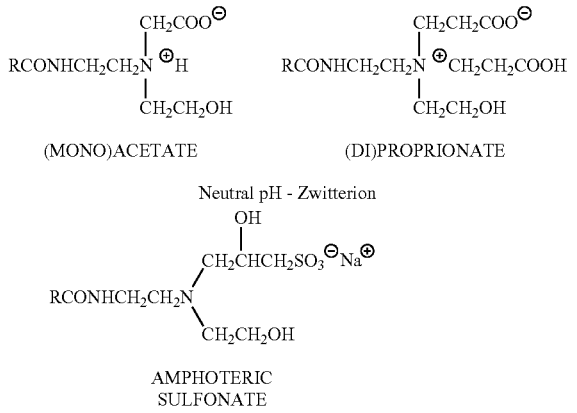

wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which R═$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+$($CH_2$—$CH_2$—$CO_2Na)_2$—$CH_2$—$CH_2$—OH or $C_{12}$-alkyl-C(O)—N(H)—$CH_2$—$CH_2$—$N^+(CH_2$—$CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J.

A typical listing of amphoteric classes, and species of these surfactants, is given in U.S. Pat. No. 3,929,678 and in "Surface Active Agents and Detergents" (Vol. I and II by Schwartz, Perry and Berch), both of which are incorporated herein by reference in their entirety.

Cationic Surfactants

In some embodiments, the cleaning compositions of the present invention include a cationic surfactant. Cationic surfactants have a positive charge on the hydrotrope portion of the molecule. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y— and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

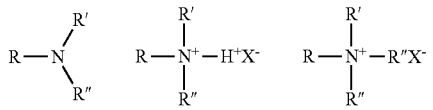

in which, R represents a long alkyl chain, R', R", and R'" may be either long alkyl chains or smaller alkyl or aryl groups or hydrogen and X represents an anion. The amine salts and quaternary ammonium compounds are preferred for practical use in this invention due to their high degree of water solubility.

The majority of large volume commercial cationic surfactants can be subdivided into four major classes and additional sub-groups known to those or skill in the art and described in "Surfactant Encyclopedia", *Cosmetics & Toiletries*, Vol. 104 (2) 86-96 (1989), which is incorporated herein by reference in its entirety. The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

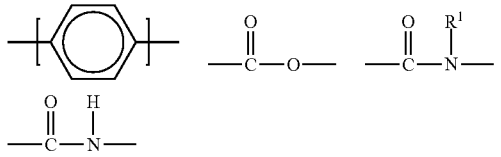

or an isomer or mixture of these structures, and which contains from about 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2 or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens. Y is can be a group including, but not limited to:

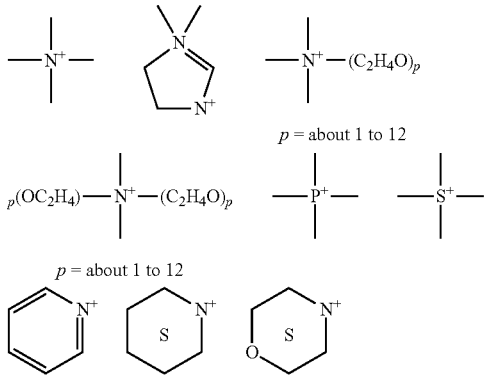

or a mixture thereof. Preferably, L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component.

Bottle Washing Additives

In some embodiments, the cleaning compositions of the present invention include one or more bottle wash additives. The cleaning compositions may optionally be combined with bottle washing additives and/or other detergents. The term "bottle washing additive" and variations thereof, as used herein, refers to surfactants, alkaline and/or acid sources and cleaning agents employed in bottle washing applications. Exemplary bottle washing additives are disclosed, for example, in U.S. Pat. No. 7,148,188 titled "Bottlewash Additive Comprising an Alkyl Diphenylene Oxide Disulfonate," which is herein incorporated by reference in its entirety.

Additional Functional Ingredients

Any number of optional ingredients may be added to the cleaning compositions of the invention. The functional ingredients provide desired properties and functionalities to the cleaning composition. For the purpose of this application, the term "functional materials or ingredients" include a material that when dispersed or dissolved in a use and/or concentrate solution, provides a beneficial property in a particular use. The cleaning composition may further comprise, consist or consist essentially of a number of other adjuvants, trace compounds, dispersants, anti-redeposition agents, stabilizing agents, dispersants, defoamers, colorants, rinse aids, catalysts, corrosion inhibitors, dyes, fragrances, preservatives and other constituents that may be useful in the invention.

Chelating/Sequestering Agents

In some embodiments, the cleaning compositions of the present invention include a chelating and/or sequestering agent. Particularly suitable chelating/sequestering agents useful according to the invention may include, but are not limited to, phosphates, phosphonates, gluconates, and so forth as disclosed in U.S. Pat. No. 7,148,188, which is herein incorporated by reference in its entirety. Phosphates suitable for use herein include, but are not limited to, monomers of phosphoric acid, polymers of phosphoric acid, salts of phosphoric acid or combinations thereof; ortho phosphates, meta phosphates, tripolyphosphates, or combinations thereof; phosphoric acid; alkali metal, ammonium and alkanolammonium salts of polyphosphates (e.g. sodium tripolyphosphate and other higher linear and cyclic polyphosphate species, pyrophosphates, and glassy polymeric meta-phosphates); amino phosphates; nitrilotrismethylene phosphates; and the like; or a combination thereof. Preferred phosphates include phosphoric acid, and monomers, polymers, and salts thereof, and the like, or a combination thereof. Suitable phosphonates include a wide variety of phosphonic acids and phosphonate salts, such as organophosphonates. As used herein, organic phosphonate or organophosphonate refers to organic phosphonates lacking any amino or imino (e.g. nitrogen) moieties. The phosphonic acid or phosphonate can include a low molecular weight phosphonocarboxylic acid such as one having about 2 4 carboxylic acid moieties and about 3 phosphonic acid groups. Some examples of organic phosphonates include 1-hydroxyethane-1,1-diphosphonic acid; $CH_3C(OH)[PO(OH)_2]_2$; 1-phosphono-1-methylsuccinic acid, phosphonosuccinic acid; 2-phosphonobutane-1,2,4-tricarboxylic acid; other similar organic phosphonates; and mixtures thereof. Additional suitable phosphonates include phosphorous acid, $H_3PO_3$, and its salts.

Phosphonic acids can be used in the form of water soluble acid salts, particularly the alkali metal salts, such as sodium or potassium; the ammonium salts; or the alkylol amine salts where the alkylol has 2 to 3 carbon atoms, such as mono-, di-, or triethanolamine salts. Preferred phosphonates include the organic phosphonates. Preferred organic phosphonates include phosphono butane tricarboxylic acid (PBTC) available from Bayer Corp. in Pittsburgh Pa. under the tradename of BAYHIBIT™ AM and hydroxy ethylidene diphosphonic acid (HEDP) such as that sold under the tradename of DEQUEST™ 2010 available from Monsanto Chemical Co. Additional description of suitable phosphate and phosphonate sequestrants suitable for use in the invention is described in U.S. Pat. No. 6,436,893, which is herein incorporated by reference herein in its entirety.

The chelating agents/sequestrants may be employed in the cleaning compositions in amounts from about 0.01 wt-% to about 50 wt-%, from about 0.1 wt-% to about 50 wt-%, more suitably about 1 wt-% to about 30 wt-%, still more preferably from about 3 wt-% to about 10 wt-%. Without limiting the scope of the invention, the ranges recited are inclusive of the numbers defining the range and include each integer within the defined range.

Defoaming Agents

In some embodiments, the cleaning compositions of the present invention include a defoaming agent. Particularly suitable defoamers may be employed in combination with surfactants and/or sequestrants. Wetting agents which can be used in the composition of the invention include any of those constituents known within the art to raise the surface activity of the composition of the invention. Generally, defoamers which can be used in accordance with the invention include silica and silicones; aliphatic acids or esters; alcohols; sulfates or sulfonates; amines or amides; halogenated compounds such as fluorochlorohydrocarbons; vegetable oils, waxes, mineral oils as well as their sulfonated or sulfated derivatives; fatty acids and/or their soaps such as alkali, alkaline earth metal soaps; and phosphates and phosphate esters such as alkyl and alkaline diphosphates, and tributyl phosphates among others; and mixtures thereof.

In some embodiments, the cleaning compositions include antifoaming agents or defoamers which are of food grade quality given the application of the method of the invention. To this end, one of the more effective antifoaming agents includes silicones. Silicones such as dimethyl silicone, glycol polysiloxane, methylphenol polysiloxane, trialkyl or tetralkyl silanes, hydrophobic silica defoamers and mixtures thereof can all be used in defoaming applications. Commercial defoamers commonly available include silicones such as Ardefoam® from Armour Industrial Chemical Company which is a silicone bound in an organic emulsion; Foam Kill® or Kresseo® available from Krusable Chemical Company which are silicone and non-silicone type defoamers as well as silicone esters; and Anti-Foam A® and DC-200 from Dow Corning Corporation which are both food grade type silicones among others. In one embodiment, the defoamer is a block copolymer of polyoxyethylene/polyoxypropylene.

Additional descriptions of suitable defoaming agents may be found, for example, in U.S. Pat. Nos. 3,048,548, 3,334,147 and 3,442,242, the disclosures of which are incorporated by reference herein.

Rinse Aids

In some embodiments, the cleaning compositions of the present invention include a rinse aid to improve water drainage/removal from treated surfaces and/or improve drying of the surface. Generally, rinse aid formulations contain a wetting or sheeting agent combined with other optional ingredients. The rinse aids are capable of reducing the surface tension of the rinse water to promote sheeting action and/or to prevent spotting or streaking caused by beaded water after rinsing is complete. Examples of sheeting agents include, but are not limited to: polyether compounds prepared from ethylene oxide, propylene oxide, or a mixture in a homopolymer or block or heteric copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule. Various additional suitable rinse aids are disclosed for example in U.S. patent application Ser. Nos. 12/706,143 and 13/101,295, which are herein incorporated by reference in their entirety.

Catalysts

In some embodiments, the cleaning compositions of the present invention include a catalyst. Catalysts may be provided in various forms, including for example metallic manganese, silver, and/or vanadium. In an aspect of the invention, a catalyst preferably includes at least one source of manganese. In some embodiments, the manganese source is derived from manganese metal, manganese oxides, colloidal manganese, inorganic or organic complexes of manganese, including manganese sulfate, manganese carbonate, manganese acetate, manganese lactate, manganese nitrate, manganese gluconate, manganese chloride or commercially available as Dragon A350 (also known as Dragon's Blood, available from Rahu Catalystics of Nottingham, U.K.), or any of the salts of salt forming species with manganese.

According to an embodiment, the catalyst includes at least one source of silver. In some embodiments, the silver source is derived from silver metal, silver oxides, silver hydroxide, colloidal silver, inorganic or organic complexes of silver, water-soluble or insoluble silver salts, including silver sulfate, silver carbonate, silver acetate, silver lactate, silver nitrate, silver gluconate, or silver chloride, or any of the salts of or salt forming species with silver. According to a still further embodiment, the catalyst includes at least one source of vanadium.

Additional description of catalysts which may be suitable for use according to the invention are provided in U.S. application Ser. No. 12/887,755, the entirety of which application is herein incorporated by reference.

Composition Formulations

Compositions for removal of adhesives or synthetic glue residues from a surface are provided according to the invention. The cleaning compositions of the present invention may be of any suitable form, including liquid, solid (such as tablets, powder/granules), paste, foam or gel, with powders and tablets. Liquid solutions are preferred according to the invention and methods of employing the cleaning compositions. The composition may be in the form of a unit dose product, i.e. a form which is designed to be used as a single portion of cleaning composition in a washing operation. Of course, one or more of such single portions may be used in a cleaning operation.

The cleaning compositions according to the invention may be provided in the form of a concentrated composition or a ready to use composition. The concentrated composition can be referred to more simply as the concentrate, and can be diluted to provide a ready to use cleaning composition. The ready to use composition can be referred to as the use composition when it is the composition to be directly applied to a surface in need of treatment according to the invention. As one skilled in the art will ascertain the cleaning composition can be provided as a concentrate for purposes of shipment and the economy of providing cleaning compositions in concentrate formulations. The concentrate is diluted with water available at the locale or site of dilution. Both concentrated and diluted ready to use cleaning compositions are encompassed by the present invention.

The cleaning compositions of the invention may be made by any suitable method depending upon their format. Suitable manufacturing methods for the cleaning compositions are well known in the art.

Methods of Cleaning

Methods of cleaning employing the cleaning compositions of the invention are included in the scope of the invention. Use of the cleaning compositions are particularly suitable for various bottle washing applications, including label removal. Beneficially, the methods of the invention provide efficient and effective label removal, while reducing the overall cost of the chemical compositions, reducing the temperature and caustic conditions and/or mechanical effects required for the label removal and cleaning of the article.

Methods according to the invention may comprise, consist of and/or consist essentially of applying a cleaning composition to a surface in need of adhesive removal and/or cleaning. The methods may further comprise the removal of an adhesive label from the treated surface.

A variety of hard surfaces may be treated with the compositions according to the invention, including for example, glass, metal and plastics, including polycarbonates, polyvinyl chloride, polyesters such as polyethylene terephthalate (commonly abbreviated PET or PETE), polyethylene naphthenate, polyethylene and other thermoplastic polymers, such as those compatible for use in beverage and food containers. Plastic containers may be made from any number of materials depending on the application, including for example, polyethylene terephthalate.

Surfaces treated according to the invention include a variety of containers that may be adapted in shape to a variety of applications. As described herein, the invention refers primarily to bottles and the cleaning of bottles, although a variety of additional containers may be treated according to the present invention and are encompassed within the scope of the invention.

A variety of labels may be removed according to the methods of the invention. Suitable labels include any adhesive-based label. Adhesive-based labels include for example both paper and metalized labels (e.g. aluminum), such as those employed on commercially-available returnable glass bottles. Adhesive-based labels may include synthetic and/or natural adhesives. An example of a synthetic adhesive is a polyacrylic acid adhesives or polymers of a polycarboxylate. An example of a natural adhesive is casein or melamine casein.

In an aspect of the invention, the methods are particularly suited for the removal of labels, including those that are adhesively applied and have been exposed to the sun. Adhesively applied labels, after sun exposure, can be extremely difficult to remove. Beneficially, the step of removing the label from the treated bottle or surface does not include the destruction of the label itself. In addition, the methods of the invention do not remove applied color designs from treated surfaces.

In an aspect of the invention, the removal of a label includes a step of forming a layer of the cleaning composition over the label and thereafter penetrating the label to effectuate removal of the label. Without being limited to a particular theory of the invention, the solvent of the cleaning composition acts to penetrate the adhesive holding of the label to the surface and/or penetrates the label from the outside (e.g. top of the label) to create micropores in the label in order to penetrate the label and thereafter solubilize and/or penetrate the adhesive component of the label. In a further aspect of the invention, the methods include the destabilization of the adhesive layer of a label. In a further aspect, the removal of aluminum labels does not require a subsequent step of deflocculation to treat a caustic/aluminum mixture, as a result of the use of lower caustic cleaning compositions.

In a further aspect, the label itself that is removed according to the methods of the invention does not dissolve and/or pulp. As a result of the label being removed intact it is easily retrievable from a wash source. Beneficially, as the label does not dissolve and/or pulp the cleaning composition in the wash solution can be used for an extended period of time in order to minimize waste sources. In a preferred aspect of the invention, the label itself that is removed further retains the adhesive.

According to an embodiment of the invention, a cleaning composition comprising a solvent is applied to a surface in need of label removal and/or cleaning. A use solution may be prepared from the concentrate by diluting the concentrate with water at a dilution ratio that provides a use solution having desired label-removing and adhesive-removing properties. The typical dilution factor is between approximately 1 and approximately 10,000 but will depend on factors including the amount and types of adhesives to be removed, temperatures and the like. In an embodiment, the concentrate is diluted at a ratio of between about 1:5 and about 1:1,000 concentrate to water. Particularly, the concentrate is diluted at a ratio of between about 1:5 and about 1:100 concentrate to water.

Preferably the cleaning composition is provided in a solution in the amounts of from approximately 0.01 wt-% to about 50 wt-%, preferably from about 0.1 wt-% to about 30 wt-%, more preferably from about 0.6 wt-% to about 10 wt-%. One skilled in the art may further vary the amount of the concentrated cleaning compositions according to the invention, depending on the initial concentration of the starting, concentrated cleaning composition and the desired applications of use thereof. Without limiting the scope of the invention, the ranges recited are inclusive of the numbers defining the range and include each integer within the defined range.

According to an embodiment of the invention, the methods of cleaning include applying the cleaning composition under a defined pH range within a label removal process and/or bottle cleaning process. Preferred pH conditions include from about 2 to about 10, preferably from about 6 to about 9, more preferably from about 6 to about 8, preferably neutral in order to avoid corrosion of treated surfaces and articles. Without limiting the scope of the invention, the ranges recited are inclusive of the numbers defining the range and include each integer within the defined range. In an aspect of the invention it is unexpected for the cleaning compositions to remove adhesive labels according to the methods at an acidic pH. As one skilled in the art will ascertain, adhesive label removal is conventionally achieved only at alkaline pH using caustic solutions.

According to a non-limiting embodiment of the invention, the lower pH of cleaning solutions improves chelation of metal ions and as a result improves the removal of adhesive residues from the bottles. In an effort to avoid corrosion of the treated surfaces and articles, corrosion inhibitors may be included in the cleaning compositions as a result of the use of acidic pHs, including for example corrosion inhibitors disclosed in U.S. Ser. No. 13/548,367 and U.S. Pat. Nos. 8,343,380, 8,207,102, 8,114,344, 8,114,343, 8,105,531, 8,021,493, 7,960,329, 7,919,448, 7,829,516, 7,828,908, 7,741,262, 7,709,434, 7,196,045, 7,196,044, and 6,835,702, each of where are herein incorporated by reference in their entirety.

According to the methods of using the cleaning compositions, the label removal takes place under lower temperature conditions in comparison to conventional label removal methods. For example, the methods may include use of the cleaning composition at temperatures below the conventional temperature range for glass label removal and/or cleaning, which is about 85° C. More preferably, the cleaning compositions are applied to a surface in need of label removal at a temperature below about 60° C., more preferably below about 50° C., more preferably below about 40° C., from about 35-40° C., and still more preferred at a temperature below about 35° C. Without limiting the scope of the invention, the ranges recited are inclusive of the numbers defining the range and include each integer within the defined range.

According to the methods of use of the present invention, lower concentrations of caustic are used with the cleaning compositions to remove labels from the treated surface. For example, conventional label removal methods may employ relatively high concentrations of caustic. According the invention, the cleaning compositions are employed with caustic concentrations below about 50%, preferably below about 25%, more preferably below about 10%. Without limiting the scope of the invention, the ranges recited are inclusive of the numbers defining the range and include each integer within the defined range. According to a preferred embodiment of the invention, the solvent in the cleaning compositions completely replaces the caustic concentration.

Beneficially the methods of cleaning according to the invention to remove bottle labels do not require any increase in time over convention bottle removal methods. Unexpectedly, despite the use of lower temperatures and less caustic concentrations and/or no caustic concentration of cleaning components, the methods of label removal do not require increased time. In some aspects, the methods of the invention achieve complete label removal in less time that conventional bottle removal methods employing higher temperature and/or more caustic cleaning compositions. Without being limited to a particular theory of the invention, the cleaning compositions provided faster penetration of the label and glue solubilization. In preferred aspects, the methods provide label removal within less than 10 minutes, preferably within less than 5 minutes, most preferably within less than 2 minutes.

The methods of label removal according to the invention employing the cleaning compositions may be applied after caustic washing tanks, after any down-line equipment in a bottle washing process (e.g. pasteurizer), washing section or any other area. Preferably, the cleaning composition is applied to a bottle washer wash tank, preferably in a use solution of a weak caustic. According to an alternative embodiment of the invention, the methods of cleaning include applying the cleaning composition to a bottle filling line, a tunnel pasteurizer's water and/or in a rinse section of bottle washer.

The methods of application of the cleaning compositions may include manual application, application using a hand operated cleaning equipment, and/or in automatic cleaning equipment with or without the assistance of mechanical action.

As one skilled in the art will ascertain, in institutional settings the machines most often used to convey bottles through an automatic cleaning process include various zones, such as prerinse or soak, rinse, cleaning, and final rinse.

The methods of the invention may be practiced with low pressure, no contact cleaning methods, high pressure scrubbing application of the cleaning compositions, friction wash with low or high pressure fluid application, presoak cleaning in 'touchless' and friction-type washes, clean-in-place (closed environment) washing systems, or any variation of cleaning formats known within the art.

All publications and patent applications in this specification are indicative of the level of ordinary skill in the art to which this invention pertains. All publications and patent applications are herein incorporated by reference to the same extent as if each individual publication or patent application was specifically and individually indicated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

The materials used in the following Examples are provided herein:

Various commercially-available stock solutions were employed in formulations (available from various sources) including: potassium iodide, citric acid (50%), gluconic acid (50%), enzymes (e.g. protease);

Glucopon 425N: Alkyl polyglycosides, C8-C14 natural fatty alcohol based, available from Stepan Company (Northfield, Ill.);

Ammonyx® LMDO: Lauramidopropylamine/Myristamidopropylamine Oxide, available from Stepan Company (Northfield, Ill.);

Bayhibit® AM: Phosphonobutanetricarboxylic acid, available from LANXESS AG (Leverkusen, Germany, DE);

Dequest® 2010: 1-Hydroxyethylidene-1,1,-diphosphonic acid, HEDP, available from Monsanto Chemical Co.;

Armeen OL: oleylamine, available from Akzo Nobel Surface Chemistry LLC (Chicago, Ill.);

Rhodiasolv® IRIS and Infinity: dibasic ester solvent, available from Solvay Rhodia;

Cola®Solv IES and OES: ionic fluids, available from Colonial Chemical (South Pittsburgh, Tenn.);

Furfuylamine: 2-aminomethylfuran, available from TCI America (Portland, Oreg.);

Tris[2-(2-methoxyethoxy)-ethyl]amine (95%), available from Sigma-Aldrich;

Commercial cleaning and floor stripping formulations commercially available from Ecolab Inc., including for example, Bendurol Maxx, Energy Forte. Neomat S, Neomat Clean and Neomat C;

Benzyl Alcohol: available from LANXESS AG (Leverkusen, Germany, DE);

4-Methylbenzylamine;

Steposol M-10: decanamide, N,N-dimethyl available from Stepan Company;

Steposol M-8_10: octanamide, N,N-dimethyl and decanamide, N,N-dimethyl blend available from Stepan Company.

Example 1

Various adhesive paper labels used in commercial glass bottling were analyzed to determine the compositional make-up of the different label adhesives (Optal LG 11, Colfix s8012 and Turmer Leim ST 50 KF). The labels and adhesives are outlined in Table 2.

TABLE 2

| Commercial Bottle Label | Front | Back |
|---|---|---|
| Label A | Alkyl ester, acrylic species | Cellulose |
| Label B | Kaolin, ester, alkyl | Carbonate, alkyl, acrylic, cellulose |
| Label C | Alkyl ester, acrylic species | Carbonate, alkyl, acrylic, cellulose |
| **Label Adhesive** | | |
| Optal LG 11 | (Synthetic) Alkyl ester, carboxylic acid salt | |
| Colfix S8012 | (Synthetic) Alkyl ester, carboxylic acid salt | |
| Turmer Leim ST 50 KF | Acrylamide, melamine casein | |

The compositional analysis of the various paper bottle labels and adhesives, including the functional groups identified, support the use of a polar and/or basic solvent (e.g. benzyl alcohol (polar), furfurylamine (basic)) to provide the effective bottle label removal formulation according to the invention. Namely, the use of the solvent in a cleaning composition supports the use of lower temperatures and lower caustic concentration without label destruction in the washer.

Example 2

The labels and adhesives examined in Example 1 were tested under various bottle washing conditions to determine the efficacy of label removal from glass slides. Each adhesive and paper label was affixed to a glass slide and the slides were placed, for the amount of time specified in a 3 L glass beaker on a hot place to achieve the specified temperatures set forth below. The labels were then peeled from the glass slide by hand and the glass slides were rinsed with cold water. The slides were then visually analyzed to determine the efficacy of each solution. The greater amount of residues remaining on the slides indicate a poorer performance.

Caustic Solution.

A 2% NaOH solution was evaluated for label removal performance on the three different adhesives at 75° C.-80° C. for 10 minutes with no agitation. Glue residue remained on all slides; it was visible as lighter patches on each slide. The 2% NaOH was not as effective on Optal LG 11 as it was on Colfix S8012 or Turmer Leim ST 50 KF.

The three commercial adhesives were further tested against various formulations as set forth in Table 3. The formulations B-E were evaluated in combination with a caustic solution. 0.25% of each formulation concentrate was combined with the caustic solution.

TABLE 3

| Components | A | B | C | D | E |
|---|---|---|---|---|---|
| Bayhibit AM (50%) | 1.00 | 0.85 | 0.94 | 1.01 | 1.05 |
| Citric acid monohydrate | 5.47 | 4.76 | 6.35 | 5.96 | 5.72 |
| Dequest 2010 | 6.5 | 5.66 | 6.45 | 6.30 | 6.39 |
| Gluconic acid (50%) | 25 | 28.81 | 25.33 | 25.89 | 26.28 |
| Potassium iodide USP | 0.25 | 0.33 | 0.34 | 0.30 | |
| Glucopon 425N | | 8.86 | 10.24 | 10.11 | 10.32 |
| Ammonyx LMDO | | 4.51 | 5.11 | 5.14 | 5.37 |
| Armeen OL | | | | | 15.65 |
| Furfuylamine | | 4.57 | | | |
| 4-methyl-benzylamine | | | 5.17 | | |
| Tris[2-(2-methoxyethoxy)-ethyl]amine | | | | 5.26 | |
| Benzyl alcohol | | 4.50 | 5.30 | 5.31 | 7.26 |
| Water | 61.78 | 37.15 | 34.77 | 34.72 | 21.96 |

The removal of Optal LG 11 adhesive was evaluated using various formulations for efficacy at a temperature of 50° C. for 20 minutes (soak time), without agitation. A commercial product, Stabilon WTN (Ecolab Inc., St. Paul, Minn.) (commercial product, referred to as "A" in Table 2) was evaluated, along with various formulations modified from formulation A to contain an amine solvent and/or a surfactant according to the invention. Formulations B, C, D and E are set forth in Table 3 and each contain the additional component (respectively) furfurylamine, 4-methylbenzylamine, Tris[2-(2-methoxyethoxy)-ethyl]amine, or Armeen OL. The compositions also include one or more surfactants (e.g. Glucopon 425N, Ammonyx LMDO, Armeen OL) and an additional solvent benzyl alcohol.

The modified bottle washing compositions provided improved residue removal in comparison to formulation A which does not contain the amine solvent, surfactants and/or benzyl alcohol solvent, demonstrating efficacy of the methods and compositions of the invention.

The removal of Colfix S8012 adhesive was evaluated using various formulations for efficacy at a temperature of 50° C. for 20 minutes (soak time), without agitation. The modified bottle washing compositions B, C and D (Table 3) provided improved residue removal in comparison to a solution of 0.5% NaOH which did not contain the amine and/or solvent, demonstrating efficacy of the methods and compositions of the invention.

The removal of Turmer Leim ST 50 KF adhesive was evaluated using various formulations for efficacy at a temperature of 50° C. for 20 minutes (soak time), without agitation. The modified bottle washing compositions B, C and D (Table 3) provided improved residue removal in comparison to a solution of 0.5% NaOH which did not contain the amine and/or solvent, demonstrating efficacy of the methods and compositions of the invention.

Example 3

The efficacy of the cleaning compositions to remove Optical LG 11 adhesive labels from glass bottles within a shortened period of time was analyzed. Testing of various formulations at increasing temperatures (from 50° C. to 80° C.) were conducted to determine the percentage of area cleaned by a tested solution within 5 minutes using the methods described in Example 2.

Various surfactants, solvents and other cleaning agents were screened for efficacy in adhesive removal according to the methods of the invention. Initially, cleaning agents screened included: ionic fluids/surfactants Cola®Solv IES and OES; RhodiaSolv Infinity surfactant; dimethylamionpropylamine solvent; dimethylcyclohexylamine; diethylcyclohexylamine; 1,8-diazobicyclo[5.4.0]undecene-7-ene; tris [2-(2-methoxyethoxy)-ethyl]amine.

The subsequently evaluated formulations evaluated are shown in Table 4 and described herein.

TABLE 4

| | Components | | | | | | |
|---|---|---|---|---|---|---|---|
| | F | G | H | I | J | K | L |
| Bayhibit AM (50%) | 1.03 | 6.70 | 1.10 | 1.06 | 1.00 | 1.07 | |
| Citric acid monohydrate | 4.93 | 5.26 | 4.93 | 4.99 | 5.00 | 5.00 | |
| Dequest 2010 | 5.96 | 6.56 | 5.96 | 5.12 | 5.13 | 4.93 | |
| Gluconic acid (50%) | 24.90 | 25.19 | 24.93 | 25.11 | 25.06 | 24.93 | |
| 2-(2-aminoethoxy)ethanol, DGA | 1.96 | | | | | | |
| Rhodiasolv IRIS | | 2.00 | | | | | |
| Amine solvent (e.g. monoethanolamine, diethanolamine, triethanolamine) | | | 1.96 | 2.06 | 2.03 | | |
| Urea (50%) | | | | | | 3.97 | 98.84 |
| Sodium dioctyl sulfosuccinate | | | | | | | 1.16 |
| Water | 61.22 | 54.28 | 61.13 | 61.66 | 61.78 | 60.10 | |

Various additional formulations evaluated using formulated floor care compositions were also evaluated as shown in Table 5.

| Components | M | N | O | P |
|---|---|---|---|---|
| Water Deionized | 50.03 | 70.71 | 51.19 | 68.23 |
| SE21 (10%) | 7.50 | | | |
| Polyquart Ampho 149 | 0.92 | | | |
| Solution of tetrasodium salt of GLDA DRM | 0.75 | | | 0.75 |
| Sodium Xylene Sulfonate, 96% | 1.25 | 8.93 | 13.75 | |

-continued

| Components | M | N | O | P |
|---|---|---|---|---|
| Sodium Alkane Sulfonate (40%) | | | | 3.92 |
| Palm Kernel FA | 4.84 | | | |
| Tall Oil FA | 18.21 | | | |
| Potassium Hydroxide, 45% | 9.83 | | | 8.21 (50%) |
| Sokolan | 4.17 | | | |
| Glucopon 425 | 2.50 | | | |
| Monoethanolamine | | 4.29 | 1.25 | 0.506 (85%) |
| Methyl glycine diacetic acid | | 0.71 | 3.7 | |
| Glycol Phenyl Ether | | 11.43 | | |
| Alcohol Ethoxylate | | 2.86 | 3.75 | |
| Decanoic Acid | | 1.07 | | |
| Palmitic acid | | | | 18 |
| Dodecyl benz sulfonic acid | | | 3.75 | |
| Boric acid | | | 5 | |
| Polyether siloxane | | | 1.25 | |
| Dicarobxylic Coconut derivative | | | 1.5 | |
| Lauryl dimethylamine oxide | | | 3.75 | |
| Propylene Glycol | | | 5 | |
| Other (dyes, fragrances, enzymes, diluent, etc.) | | | 6.1 | 0.39 |

The results are shown in Table 6 comparing the temperatures the various formulations were tested at and the resulting efficacy of label removal (shown as percentage of area cleaned).

TABLE 6

| Formula | Temperature | % Area Cleaned |
|---|---|---|
| F (2%) | 50° C. | 41.17 |
| N (2%) | 50° C. | 24.63 |
| M (2%) | 50° C. | 35.16 |
| O (2%) | 50° C. | 60.07 |
| A | 60° C. | 17.89 |
| G | 60° C. | 51.10 |
| M | 60° C. | 38.49 |
| N | 60° C. | 45.76 |
| O | 60° C. | 24.06 |
| P | 60° C. | 70.94 |
| A | 70° C. | 44.57 |
| G | 70° C. | 77.55 |
| M | 70° C. | 73.57 |
| N | 70° C. | 38.60 |
| O | 70° C. | 31.98 |
| P | 70° C. | 79.99 |
| F | 75° C. | 79.67 |
| H | 75° C. | 44.64 |
| I | 75° C. | 88.90 |
| J | 75° C. | 52.88 |
| K | 75° C. | 42.32 |
| L | 75° C. | 6.32 |
| K (2% NaOH) | 80° C. | 52.22 |
| L (2% NaOH) | 80° C. | 23.46 |
| F | 80° C. | 37.27 |
| M | 80° C. | 95.03 |
| N | 80° C. | 92.36 |
| O | 80° C. | 96.30 |
| F (2%) | 80° C. | 47.71 |
| M (2%) | 80° C. | 9.67 |
| N (2%) | 80° C. | 2.11 |
| O (2%) | 80° C. | 33.19 |
| F (0.5%) | 80° C. | 79.50 |
| N (0.5%) | 80° C. | 32.83 |
| M (0.5%) | 80° C. | 74.89 |
| O (0.5%) | 80° C. | 79.01 |

TABLE 6-continued

| Formula | Temperature | % Area Cleaned |
|---|---|---|
| F (2%) | 80° C. | 44.57 |
| N (2%) | 80° C. | 4.84 |

The screening results show various formulations according to the invention and the efficacy of removal of the Optigal LG 11 adhesive at various concentrations and temperature conditions. The results are graphically shown in FIG. 1.

Example 4

Additional label removal testing was conducted at 50° C. and 80° C. to evaluate the efficacy of the cleaning compositions to remove Label B (see Table 2) from glass bottles. A 2% NaOH caustic solution was employed with various cleaning compositions according to the invention provided in the amount of 0.3%. Deionized water was employed. The adhesives evaluated included casein and synthetic adhesives. The goal of the testing was to determine cleaning compositions able to completely remove the adhesive label in the shortest period of time. The tested formulations included formulations A, G, M, N, O, along with additional commercial products, including Bendurol Maxx, Energy Forte, Neomat C, and Neomat Clean.

Figure 2:
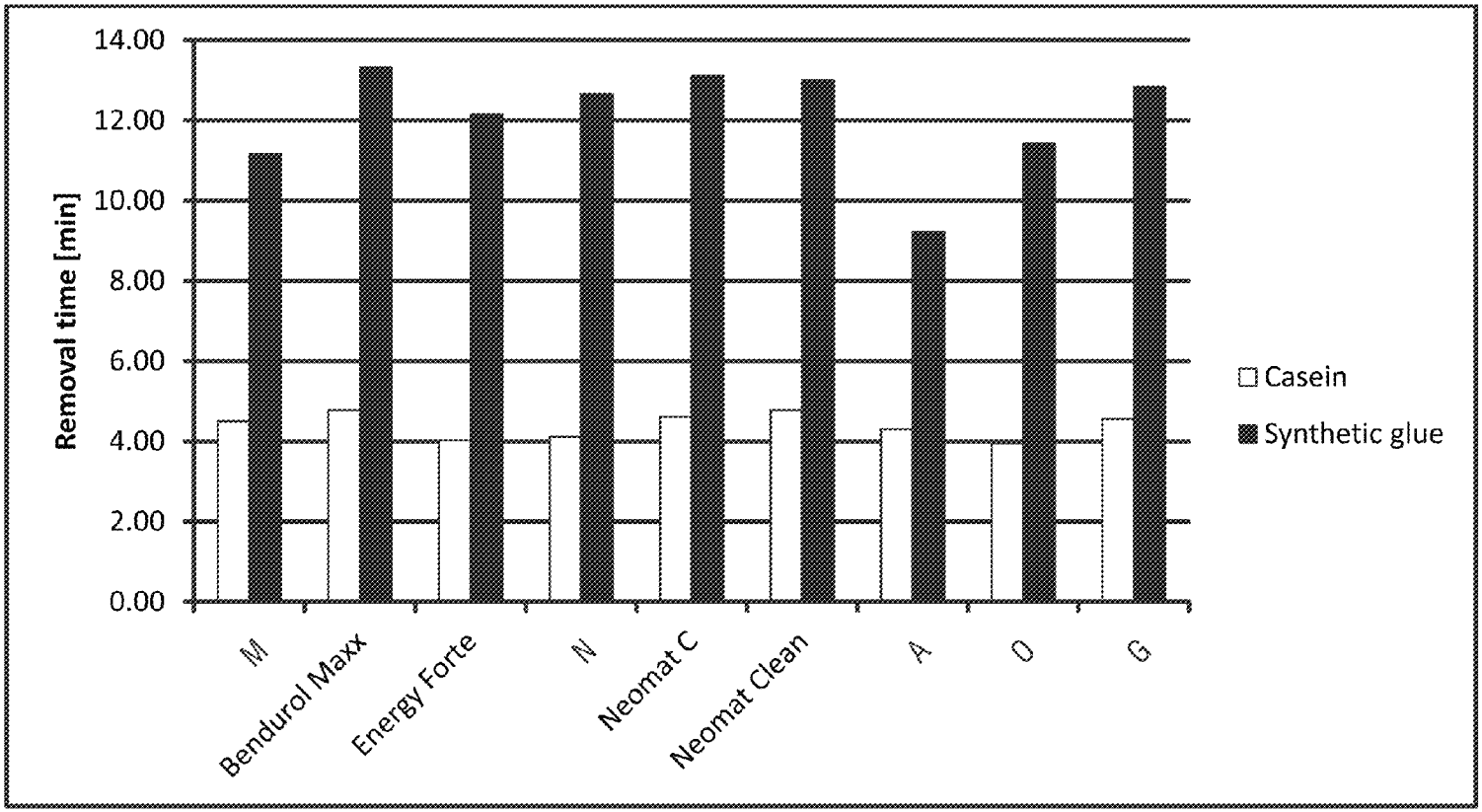
FIGS. 2-4 show graphical results of adhesive removal efficacy according to embodiments of the invention set forth in Example 4.
Figure 3:
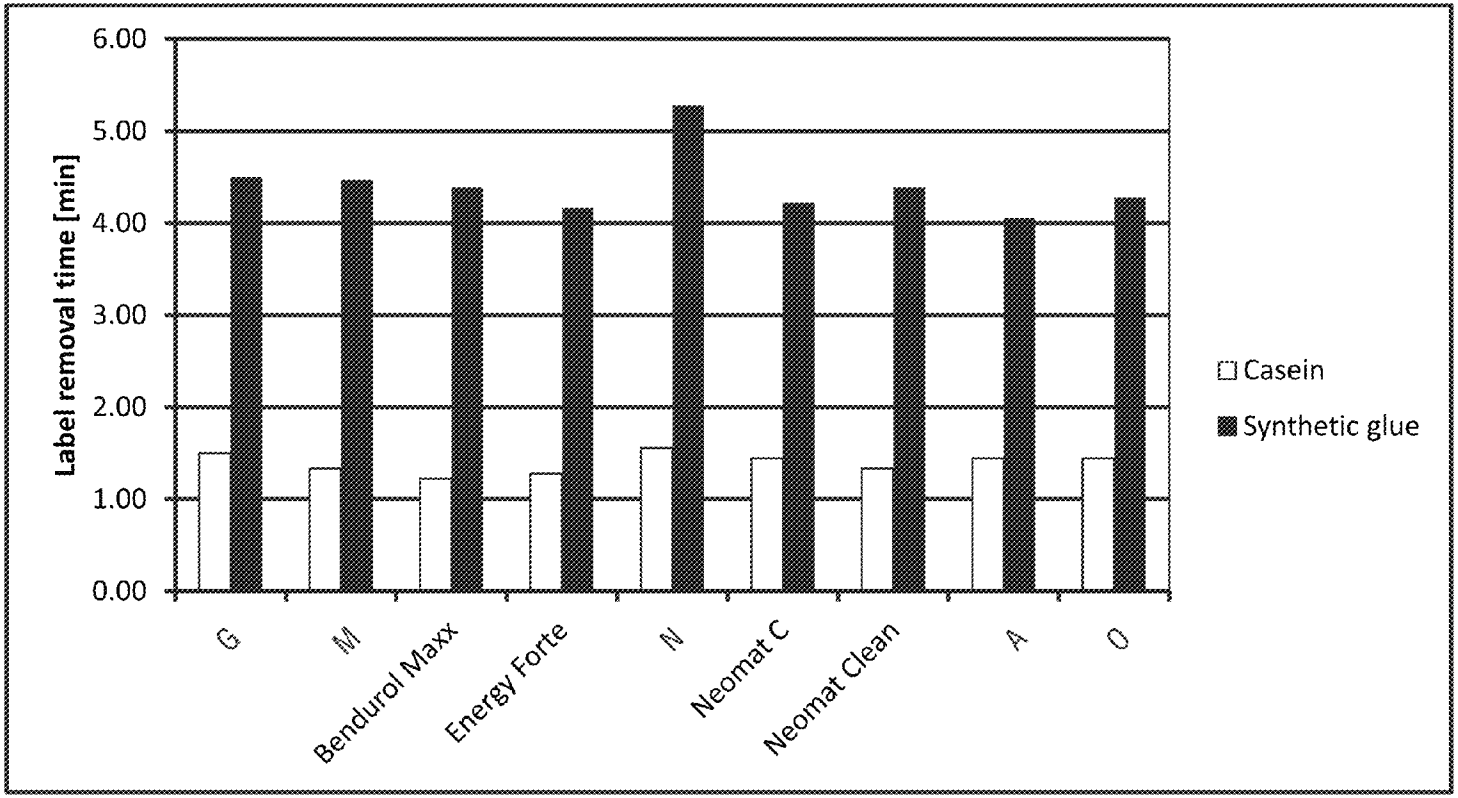
Figure 4:
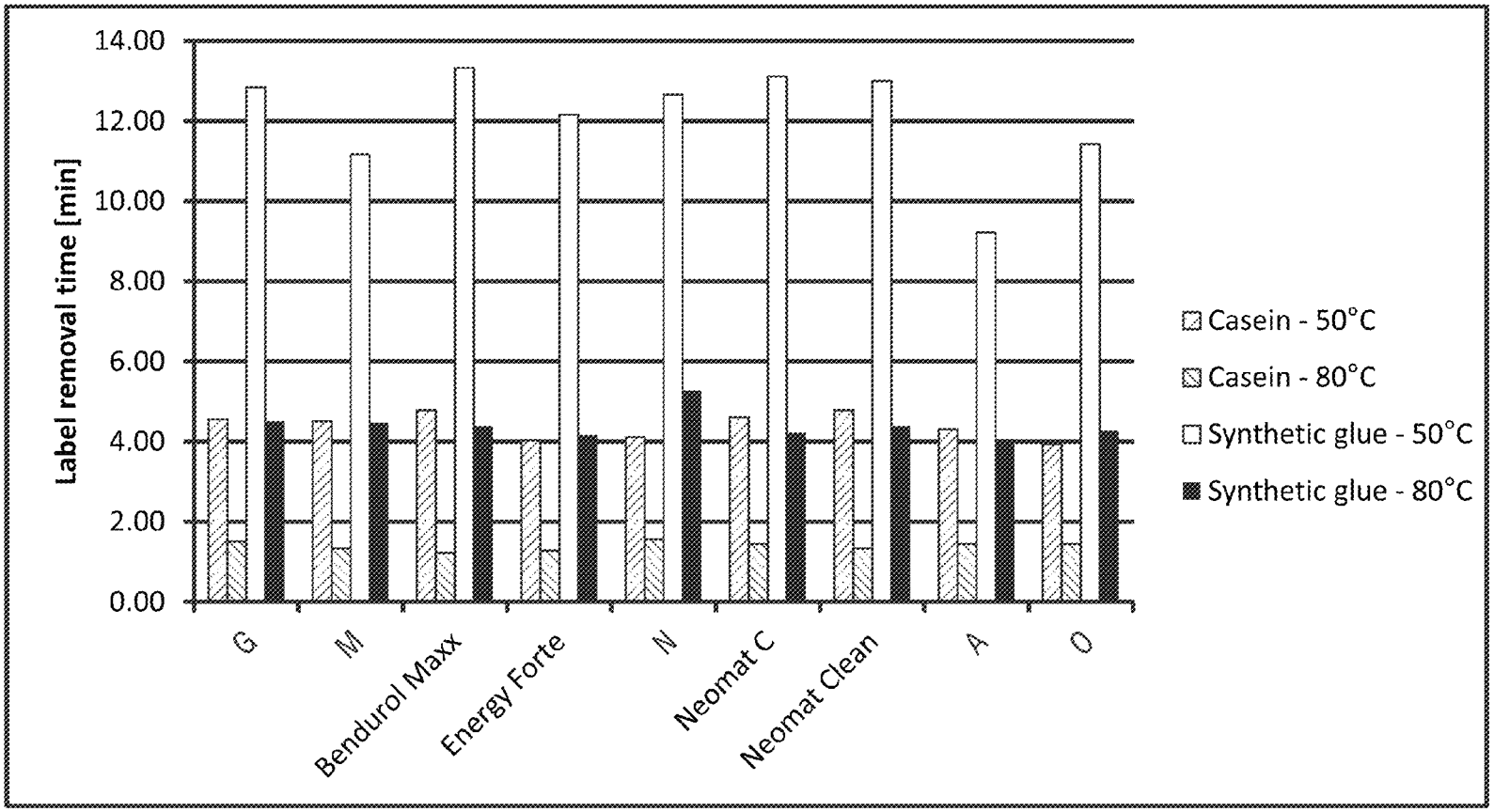

The results in FIG. 2 show the significantly reduced time required for the casein adhesive removal from the tested labels, in comparison to the synthetic glue. Beneficially, the casein was removed in less than 5 minutes by all evaluated formulations at the lower temperature of 50° C. FIG. 3 again shows the significantly reduced time required for the casein adhesive removal from the tested labels, in comparison to the synthetic glue at 80° C. FIG. 4 shows the results of both 50° C. and 80° C. testing in the single graph.

Example 5

Additional label removal testing was conducted at 50° C. and 80° C. using reduced caustic in various evaluations to determine whether reduced (preferably eliminated caustic) could be employed for label removal according to the invention. 2% NaOH and 0.5% NaOH were employed with various cleaning compositions according to the invention along with a comparison of 0% NaOH (deionized water alone with the formulation) provided in the amount of 0.3%. Deionized water was employed. The adhesives evaluated included casein and synthetic adhesives. The tested formulations included formulations F-P. Visual evaluations were made to determine the amount of the adhesive removed (measured in accordance with remaining adhesive residue on the glass surface).

Figure 5:
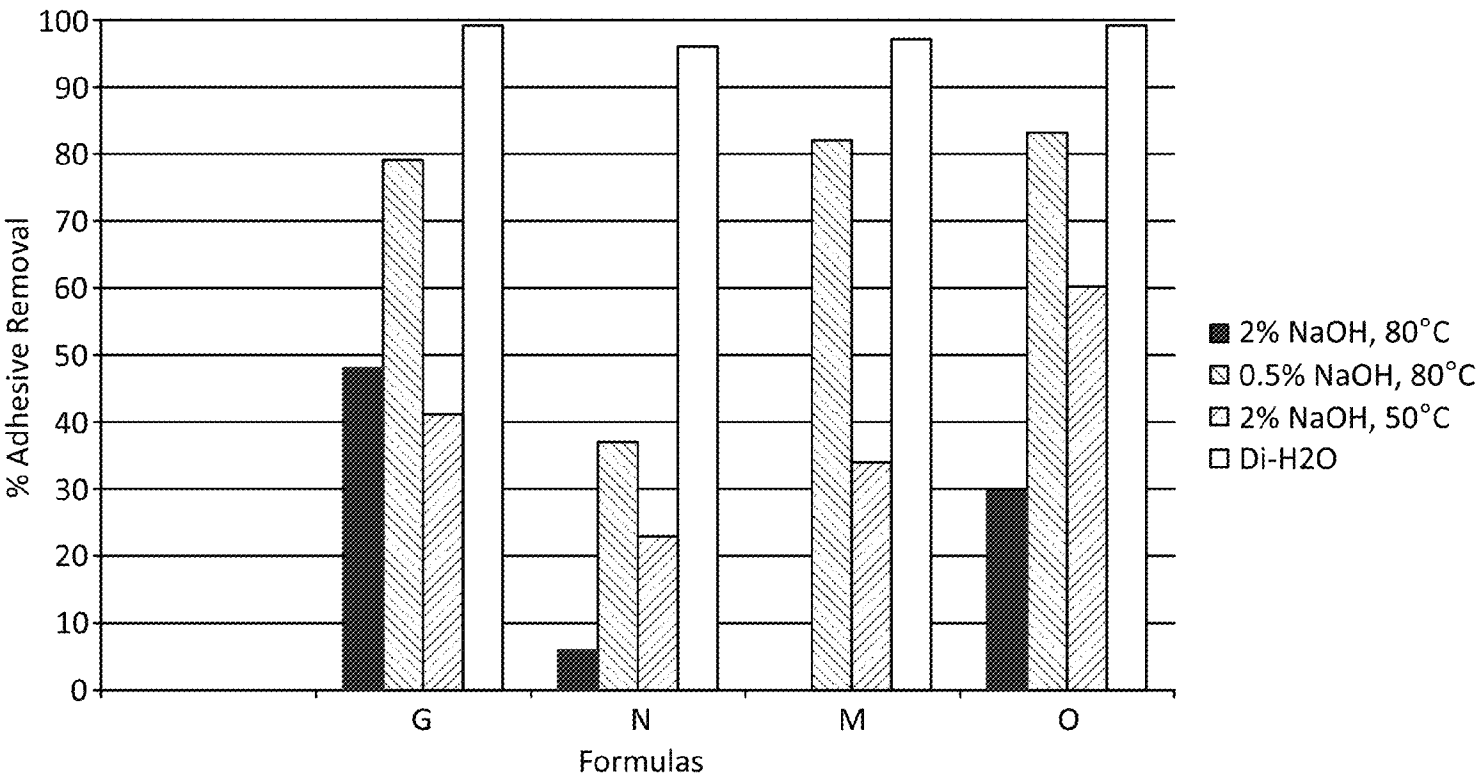
FIGS. 5-10 show graphical results of adhesive removal efficacy according to embodiments of the invention set forth in Example 5.
Figure 6:
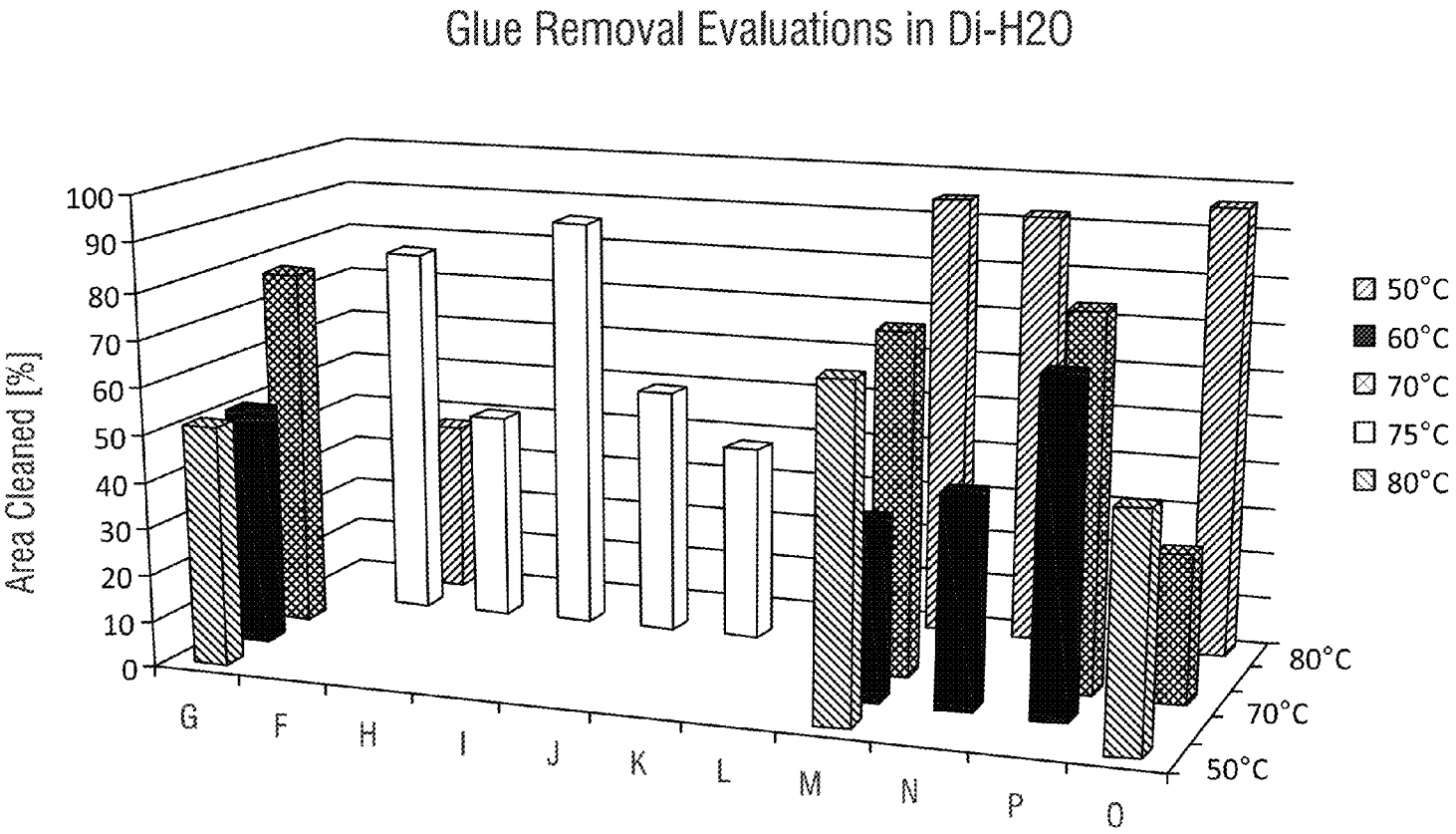

The results in FIG. 5 show the unexpected improvement of the near complete removal of the adhesive labels using the cleaning compositions in deionized water (free of caustic). The reduced caustic formulations (at 80° C.) also provided improved label removal using the cleaning composition formulations in comparison to the 2% NaOH caustic solutions employing the cleaning composition formulations.

Figure 7:
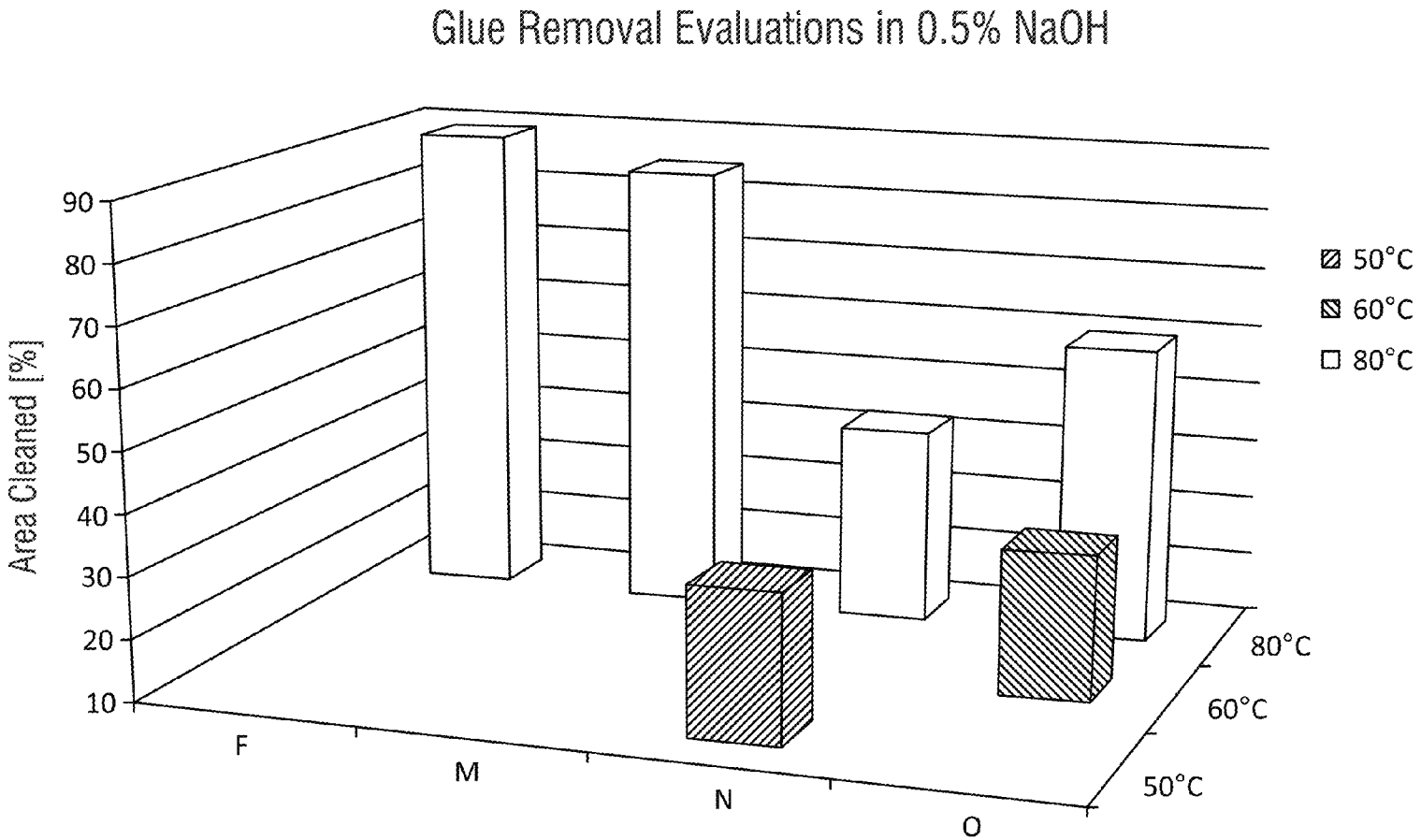
Figure 8:
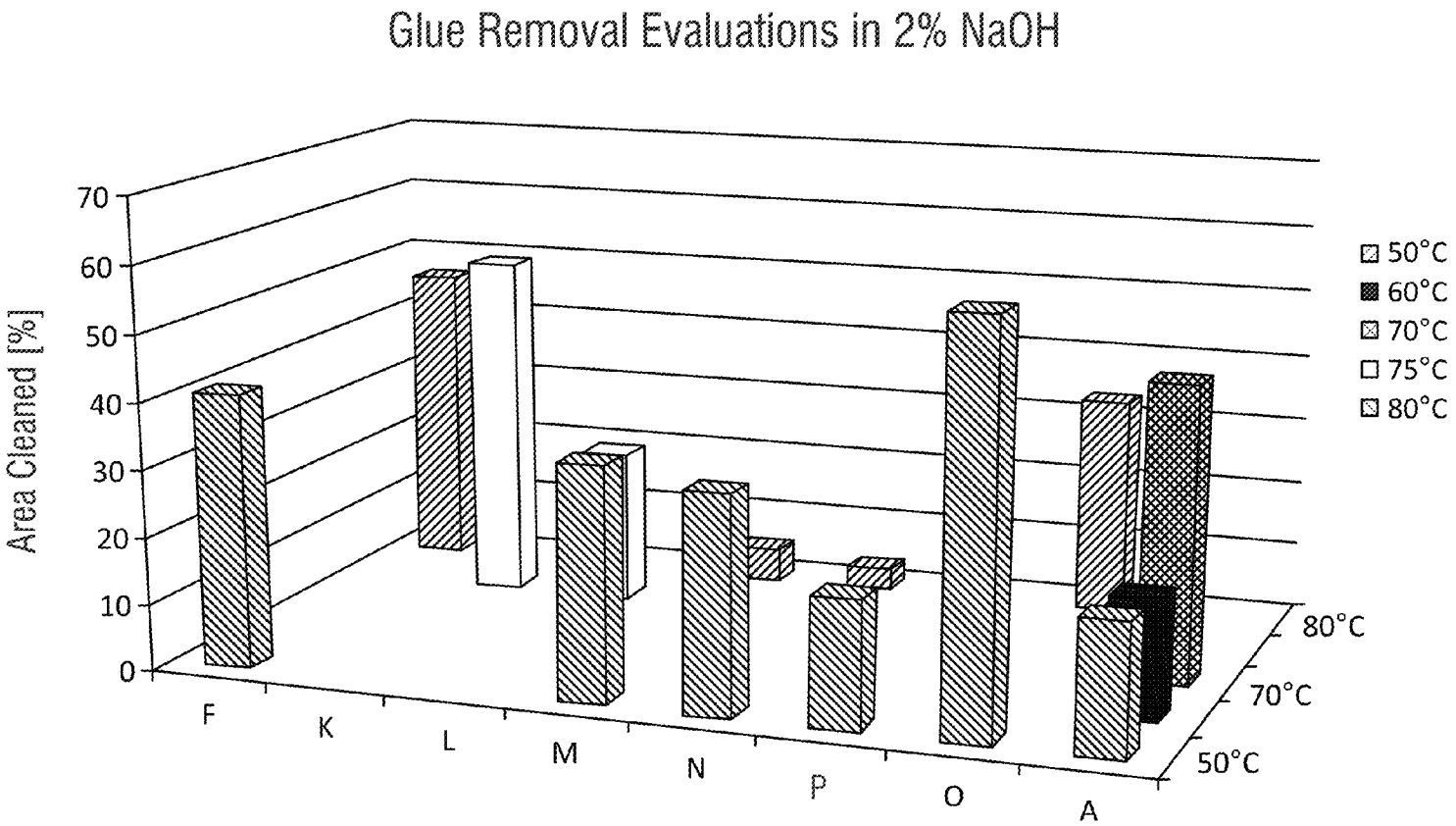
Figure 9:
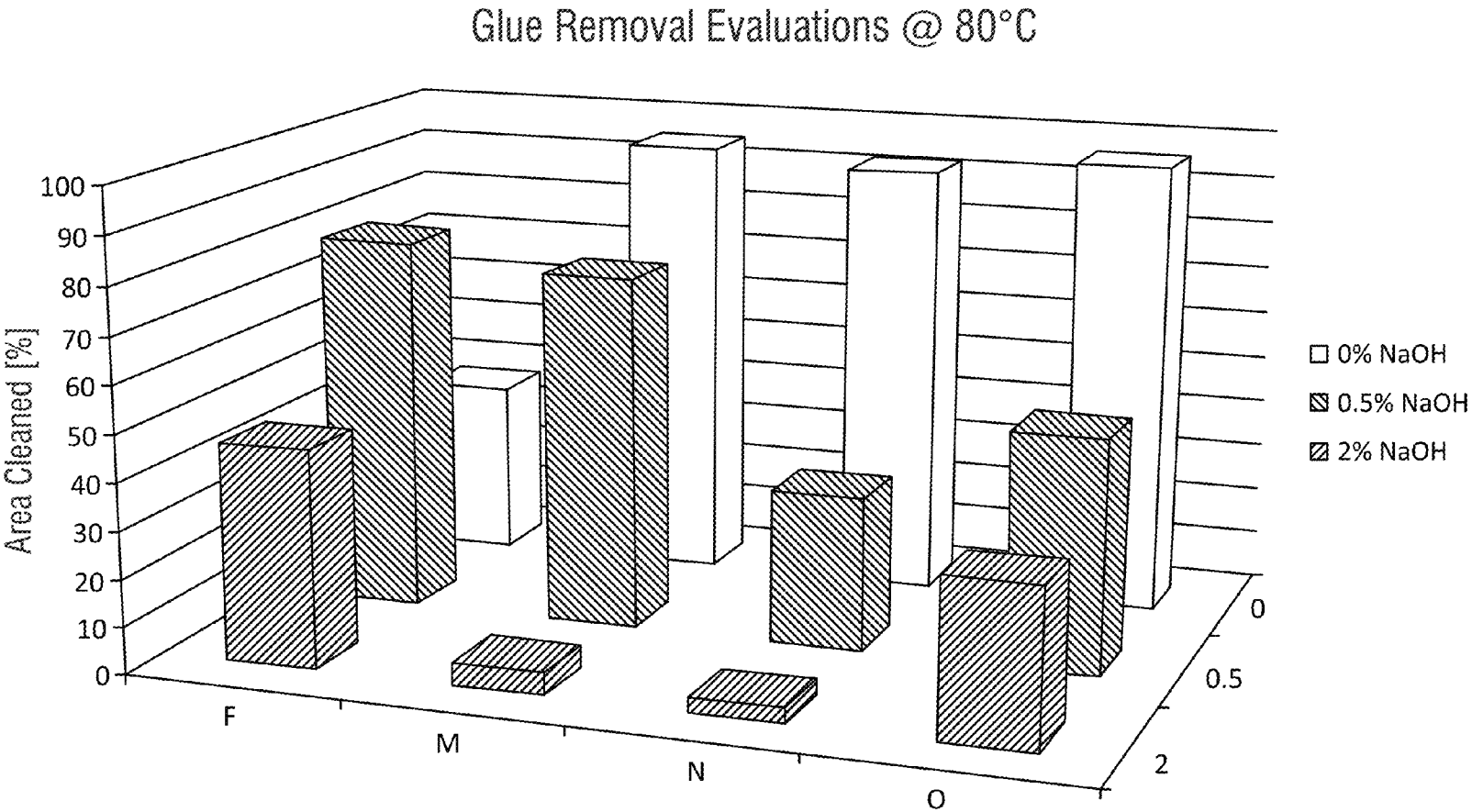
Figure 10:
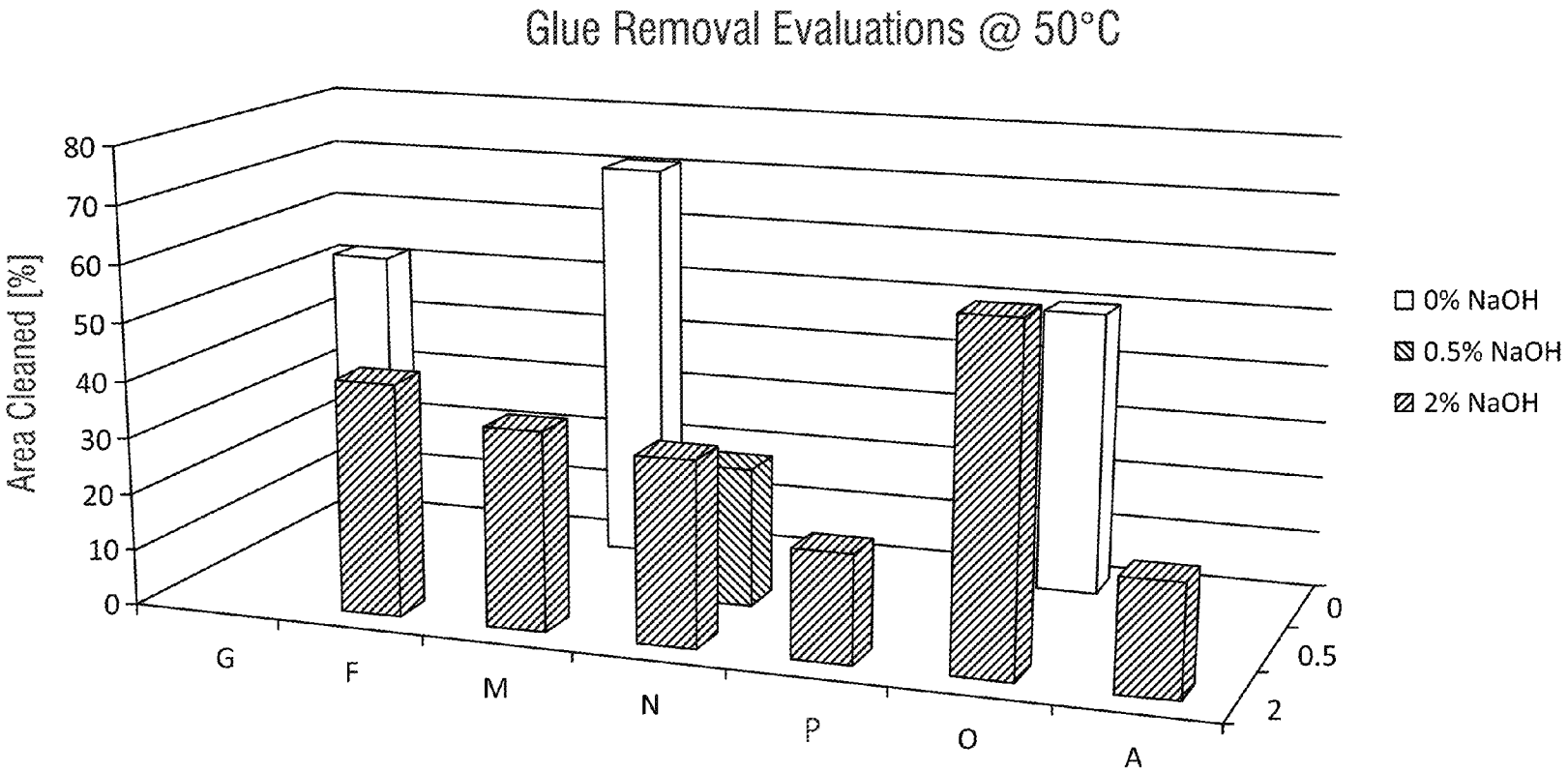

FIGS. 6-9 show additional formulations evaluated at a greater range of temperatures from 50° C. to 80° C. Although some formulations performed better at higher temperatures, various formulations performed well at the reduced temperatures. FIG. 7 shows the removal in a reduced caustic solution of 0.5% NaOH. FIG. 8 shows the removal in a 2% NaOH solution employing the various cleaning composition formulations. FIGS. 9-10 show comparisons of the efficacy of the cleaning composition formulations in varying concentrations of caustic in 80° C. and 50° C., respectively.

Example 6

The testing of Example 5 was reevaluated at a temperature of 60° C. using the glass coupons having paper labels affixed with a synthetic glue. The tested formulations contained either of 0.5% and 2% NaOH and were compared to baseline compositions of 0% NaOH (deionized water alone, shown as "water") and a 2% NaOH control formulation. The tested formulations according to embodiments of the invention included A, M and G formulated in either 0.5% or 2% NaOH, with the pH of each composition shown in Table 7.

TABLE 7

| | pH (0.5%) | pH (2%) |
|---|---|---|
| Acidic Solutions | | |
| G | 3 | 2 |
| A | 3 | 2 |
| Alkaline Solutions | | |
| M | 8 | 10 |

Figure 11:
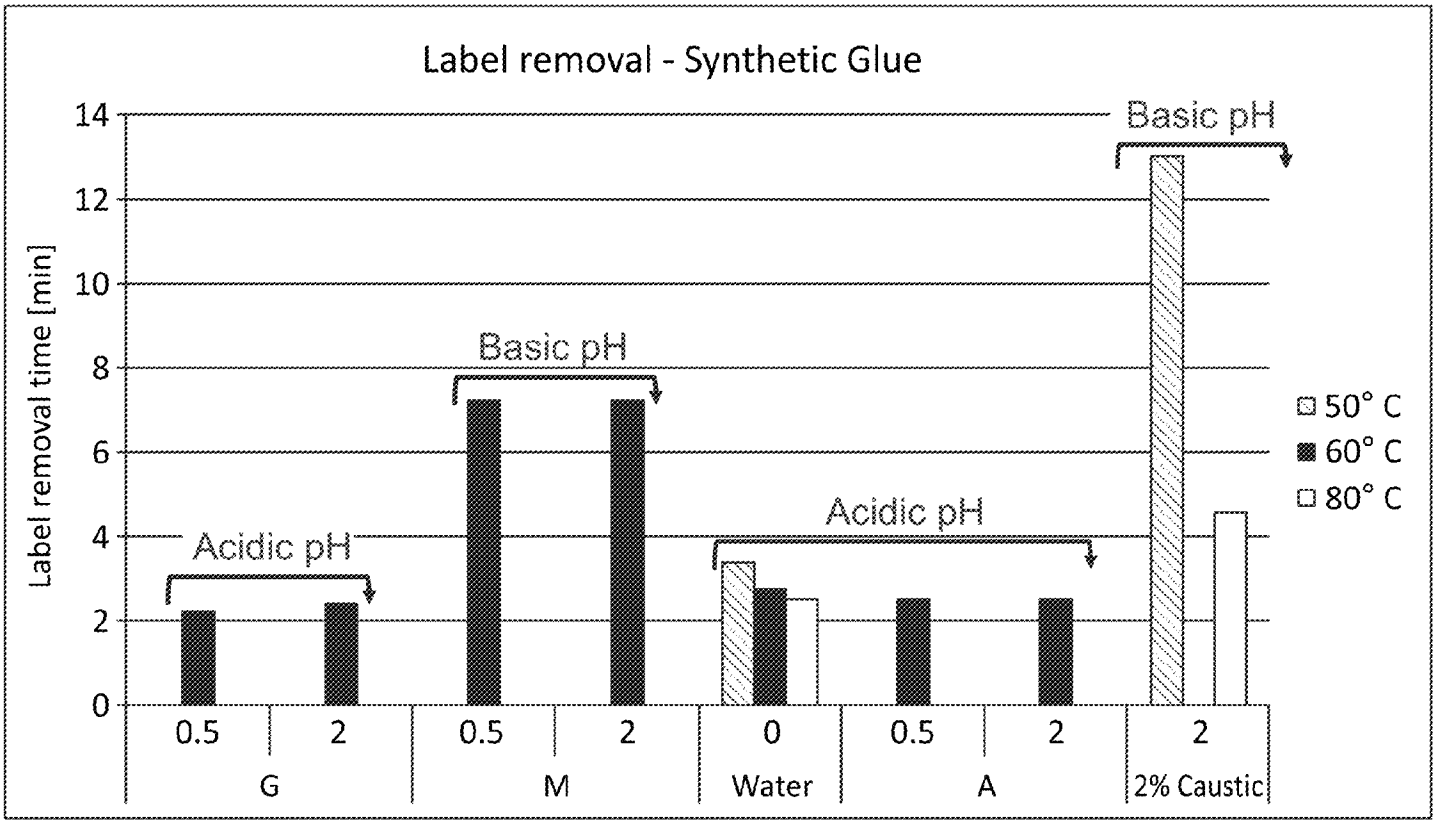
FIG. 11 shows graphical results of the synthetic adhesive removal efficacy of compositions according to the invention as set forth in Example 6.

The results in FIG. 11 show comparisons of the efficacy of label removal over time comparing the cleaning composition formulations at both 0.5% and 2% NaOH concentration at varying temperature conditions and acidity conditions. The results shown that the formulations A and F performed best with acidic formulations requiring less than 3 minutes for complete removal of the adhesive labels. These results were similar to the acidic deionized water.

The results shown in FIG. 11 further suggest that the alkaline formulations have a negative interaction with synthetic adhesives, as shown by formulation M requiring a longer period of time to remove the synthetic adhesive. Beneficially, all formulations outperformed (i.e. reduced adhesive removal time) in comparison to the 2% NaOH (caustic) formulation. This data clearly shows the impact on removal time (according to the methods of the invention) for the compositions when removing synthetic glues is dependent upon the pH of the cleaning solution.

Example 7

Figure 12:
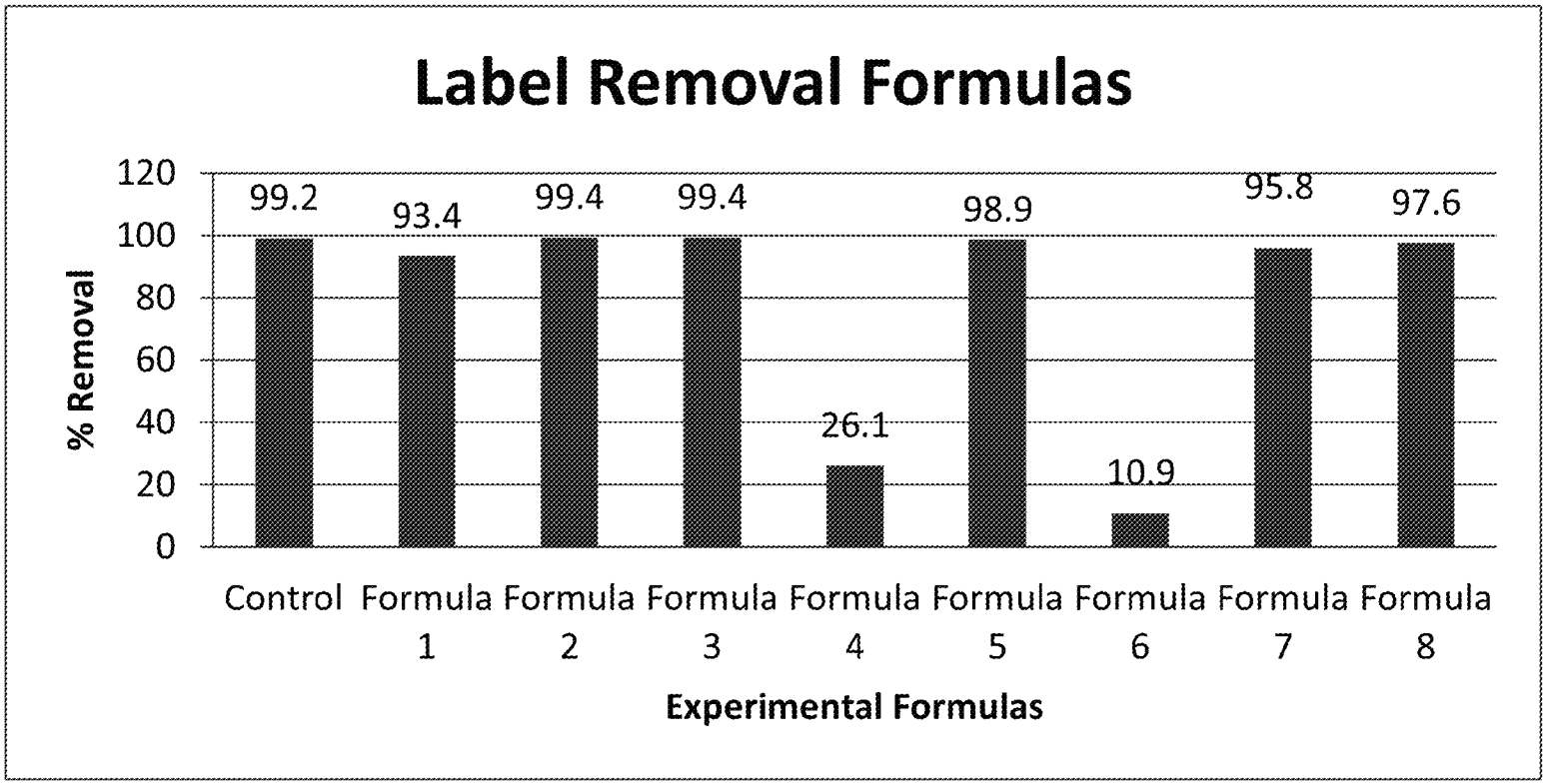
FIG. 12 shows graphical results of adhesive removal efficacy according to the embodiments of the invention set forth in Example 7.

The labels and adhesives examined in Example 1 were tested under various bottle washing conditions to determine the efficacy of label removal from glass slides. Each adhesive and paper label was affixed to a glass slide and the slides were placed for 2 minutes to 10 minutes, in a 3 L glass beaker on a hot place to achieve the specified temperatures set forth below. The labels were then peeled from the glass slide by hand and the glass slides were rinsed with cold water. The slides were then visually analyzed to determine the efficacy of each solution. As depicted in FIG. 12, the greater amount of label residue remaining on the slides (having a lower percentage of removal) is indicative of a poorer performance. The Control evaluated (99.2% "removal") was an unsoiled (i.e. no label affixed to the slide) and therefore untreated portion of the slide. Accordingly, any formulations outperforming the Control (99.% removal) demonstrate commercially-acceptable formulations. In addition, formulations approaching the Control performance—having decreased temperature and caustic (lower pH) conditions represent potentially commercially-acceptable formulations due to method of use improvements.

The evaluated formulations are shown in Tables 8-10 and described herein. The formulations had near-neutral pH (from 6-8.98), excluding formulation 8 (citric/gluconic acid in formulations) which had a pH of 2.

TABLE 8

| Component | 1 wt. % | 2 wt. % | 3 wt. % |
|---|---|---|---|
| Deionized Water | 95.07 | 94.86 | 94.93 |
| Chemeen C-15 (ethoxylated alkyl cocoamine) | 2.92 | 3.07 | 2.99 |
| Steposol M-10 (Saturated decanaminde, N,N-dimetyl-) | 2.01 | 0.00 | 0.00 |
| DBE-5 Dibasic Ester (Dimethyl Glutarate) | 0.00 | 2.07 | 0.00 |
| DBE-6 Dibasic Ester | 0.00 | 0.00 | 2.08 |

TABLE 9

| Component | 4 wt. % | 5 wt. % | 6 wt. % |
|---|---|---|---|
| Deionized Water | 94.77 | 94.96 | 94.85 |
| Chemeen C-15 (ethoxylated alkyl cocoamine) | 3.17 | 1.51 | 3.03 |
| Steposol M-8-10 (Saturated octanamide and decanaminde, N,N-dimetyl-) | 2.06 | 0.52 | 0.00 |
| Steposol M-10 (Saturated decanamide, N,N-dimethyl-) | 0.00 | 0.00 | 1.10 |
| Rhodiasolv IRIS (aliphatic dibasic acid ester) | 0.00 | 0.50 | 1.02 |

TABLE 10

| Component | 7 wt. % | 8 wt. % |
|---|---|---|
| Soft Water, O gpg tap | 70.01 | 68.64 |
| Potassium Iodide | 0.00 | 0.00 |
| Citric Acid-50% | 0.00 | 5.23 |
| Gluconic Acid-50% | 0.00 | 25.17 |
| Rhodiasolv IRIS (aliphatic dibasic acid ester) | 10.05 | 0.00 |
| Glucose Oxidase | 0.00 | 0.97 |
| Glycol Ether Solvent System | 19.94 | 0.00 |

The results in FIG. 12 show comparisons of the percent of label removal over time of each formulation tested.

Formulation 1 employing an amine and saturated amide (2 wt. %) provided commercially-suitable label removal at a 93.4% removal.

Formulations 2 and 3 employing dibasic esters (2 wt. %) outperformed the Control (i.e. indicative of complete label removal). Formula 2 indicates that the presence of a dibasic ester in an amount of at least 2 wt. % achieves the desired results, whereas the success of Formula 3 indicates there is a synergy between the amine and ester where the concentration of both are decreased, specifically where the amine concentration is decreased to about 1 wt. %.

Formulations 4 and 6 did not provide any significant adhesive removal. Formulation 4 employed a shorter carbon chain amide solvent (including C8), demonstrating the need for the amide solvent to have >C8 structure to provide suitable adhesive removal properties. Formulation 6 provided a decreased concentration of a C10 amide solvent (1.1 wt. %) in combination with the amine solvent. Although the longer chain amide solvent is capable of providing adhesive removal properties, a concentration of about 2 wt. % or greater is preferred.

Formulation 5 demonstrates commercially-acceptable adhesive removal properties employing a combination of C8-C10 amide with an amine solvent and a dibasic acid ester. The amide solvent employs less than the 2 wt. % concentration; however the synergy provided by the combination with amine solvent and/or dibasic acid ester unexpectedly allows such a decrease in concentration.

Formulations 7 and 8 do not include an amide solvent according to embodiments of the invention. Instead the positive control formulations show that formulations employing the amide, or the amide and amine and/or ester formulations provide improved outcomes over label removal formulations employing highly acidic compositions (Formulation 8) and/or other adhesive removal compositions (Formulation 7).

The inventions being thus described, it will be obvious that the same may be varied in many ways. Such variations are not to be regarded as a departure from the spirit and scope of the inventions and all such modifications are intended to be included within the scope of the following claims.

What is claimed is:

1. A method for removing labels containing adhesive material from a surface comprising:

applying a cleaning composition to a surface in need of removal of an adhesive material affixing a label to a surface; and removing said adhesive material from the surface within a period of time less than about 10 minutes;

wherein the cleaning composition comprises an aqueous or non-aqueous saturated or unsaturated amide solvent, a chelant, a surfactant, and less than about 25 wt-% sodium hydroxide (caustic), wherein the amide solvent replaces at least a portion of a caustic solution, and wherein the temperature of the cleaning composition is below about 50° C. and the pH conditions of the cleaning composition is below about 10.

2. The method of claim 1 wherein the cleaning composition has a pH of at least about 6 and less than 9, and the amide solvent has a $R_nE(O)xNR'_2$ functional group, wherein R and/or R' is H or an organic group, n is at least 1, E is C, S, or P, and x is at least 1.

3. The method of claim 1 wherein the cleaning composition completely replaces the caustic solution.

4. The method of claim 1 wherein the cleaning composition is at a temperature below about 35° C., pH between about 6 and 8, wherein the adhesive material remains on the label intact, and removes said adhesive material within a period of time less than about 5 minutes.

5. The method of claim 1 wherein the amide solvent has a saturated alkyl group, and the cleaning composition further comprising an additional solvent selected from the group consisting of amines, amine alcohols, esters, alcohols, polyols, lower alkanols, lower alkyl ethers, glycols, aryl glycol ethers, lower alkyl glycol ethers, and combinations thereof, wherein the total concentration of solvents is from about 1 wt-% to about 10 wt-%.

6. The method of claim 1 wherein the adhesive materials completely removed from the surface along with the complete removal of the label without compromising any cleaning performance on the surface and/or creating any pulping or other residue within a cleaning system.

7. The method of claim 1 wherein the adhesive material has one or more layers of adhesive, laminate and/or other synthetic or natural adhesive residue, and wherein one of more of said layers is an polyacrylic acid or polycarboxylate.

8. A method for removing adhesive material from a glass surface comprising:

applying a cleaning composition to a glass surface in need of adhesive removal; and removing said adhesive from the glass surface within a period of time less than about 10 minutes;

wherein the adhesive has one or more layers of adhesive, laminate and/or other synthetic or natural adhesive residue, and wherein one of more of said layers is a polyacrylic acid or aminocarboxylate, wherein the cleaning composition comprises from about 1 wt-% to about 10 wt-% of an aqueous or non-aqueous amide solvent, optionally an additional amine and/or ester solvent, at least one surfactant, a chelant, and less than about 25 wt-% sodium hydroxide, wherein the amide solvent replaces at least a portion of a sodium hydroxide from the cleaning composition, wherein the cleaning composition has a pH between about 5 to 10, and wherein the cleaning composition is applied at a temperature less than about 35° C.

9. The method of claim 8 wherein the cleaning composition has a pH of at least 6 but less than 9, and wherein the amide solvent has a saturated alkyl group and at least C8 structure, wherein the amine and/or ester solvent in combination with the amide solvent provide at least about 2 wt-% concentration.

10. The method of claim 9 wherein the surfactant is an anionic surfactant, nonionic surfactant, amphoteric surfactant and/or cationic surfactant.

11. The method of claim 8 wherein the cleaning composition is substantially-free of caustic and removes said adhesive from the glass surface within a period of time less than about 5 minutes.

* * * * *